US005289250A

United States Patent [19]

Hiroi et al.

[11] Patent Number: 5,289,250

[45] Date of Patent: Feb. 22, 1994

[54] SHEET POST-PROCESSING APPARATUS HAVING SHEET ALIGNER

[75] Inventors: Masakazu Hiroi, Kanagawa; Kenji Kobayashi, Itabashi; Naho Wakao, Tokyo, all of Japan

[73] Assignee: Canon Kabushiki Kaisha, Tokyo, Japan

[21] Appl. No.: 767,842

[22] Filed: Sep. 30, 1991

[30] Foreign Application Priority Data

Sep. 29, 1990 [JP] Japan ..... 2-262290

[51] Int. Cl.[5] ..... G03G 15/00

[52] U.S. Cl. ..... 355/311; 271/171; 355/309; 355/324

[58] Field of Search ..... 355/309, 323, 319, 311, 355/308, 324, 322, 321; 271/171, 162, 225; 270/53

[56] References Cited

U.S. PATENT DOCUMENTS 4,650,176 3/1987 Sugizaki et al. ..... 271/225
4,849,786 7/1989 Murakami ..... 355/322
4,864,368 9/1989 Muramatsu ..... 355/309
4,878,656 11/1989 Honjo et al. ..... 270/53
4,965,629 10/1990 Hiroi et al. ..... 355/250
5,011,130 4/1991 Naito et al. ..... 271/288
5,032,876 7/1991 Murakami ..... 355/324

FOREIGN PATENT DOCUMENTS 0109449 5/1988 Japan ..... 355/324
1-17172 5/1989 Japan ..... 355/324

*Primary Examiner*—A. T. Grimley
*Assistant Examiner*—Thu Dang
*Attorney, Agent, or Firm*—Fitzpatrick, Cella, Harper & Scinto

[57] ABSTRACT

A sheet post-processing apparatus includes trays for accommodating discharge sheets; an aligning device for aligning the sheets on said trays by urging edges of the sheets; a driver for driving the aligning device; supporting device for supporting said aligning device for rotation; and a controller for controlling the driver to change a degree of the urging of the aligning device in accordance with a size of the sheets accommodated in the tray.

14 Claims, 31 Drawing Sheets

SHEET POST-PROCESSING APPARATUS HAVING SHEET ALIGNER

FIELD OF THE INVENTION AND RELATED ART

The present invention relates to a sheet post-processing apparatus having a sheet aligner which is used for sorting or stacking sheet materials (sheets) such as copy sheets, transfer sheets or recording sheets discharged from an image forming apparatus such as a copying machine, printer or another recording machine, more particularly to a sheet post-processing apparatus capable of sorting and stapling the sheets.

In a sheet post-processing apparatus having a sheet aligner, there are provided a reference wall for abutment with one end of the sheet and a swingable arm or the like for urging the other end of the sheet toward the reference wall The sheets discharged from an image forming apparatus are sequentially abutted to the reference wall, thus aligning the sheets In one type, two swingable arms are used which are both moved to align the sheets.

As for the means for aligning the sheets in bins of a sheet post-processing apparatus, a swingable arm penetrates through a part of the bins which are stacked substantially vertically, so that all of the sheets in all of the bins are aligned by one swingable arm. Generally, the aligning rod swings along a part-circle about a reference to align the sheet materials.

In such an apparatus, the aligning member is moved in an arcuated path, the direction of the urging by the aligning member to the sheet end is different if the urging position, that is, the size of the sheet is different. In the case of a sheet having a large width, it is contacted to the end at a generally large angle, but in the case of the small size sheet, the angle is small. In this case, the swinging aligning member slightly slides on the sheet end after the start of the contact of the aligning member to the sheet end until it stops. The urging force of the aligning member is larger if the sheet width is smaller.

A degree (amount) of the urging is defined as a difference (a) between a distance 1 between the reference wall and the aligning member and a sheet width L. Even if the amount of sheet urging ($L-1=a$) is constant, the urging force of the aligning member to the sheet is different if the size of the sheet is different. Particularly when a small number of small size sheets are aligned, the sheet ends contacted by the aligning member are easily collapsed or damaged. Since the urging direction produces moment in the stacked sheet, the aligning performance is influenced.

SUMMARY OF THE INVENTION

Accordingly, it is a principal object of the present invention to provide a sheet post-processing apparatus wherein substantially a constant urging force is applied to the sheets irrespective of the size of the sheets.

It is another object of the present invention to provide a sheet post-processing apparatus wherein the sheet urging force of the aligning member is changed in accordance with information relating to the width of the sheets to be aligned.

According to an aspect of the present invention, there is provided a sheet post-processing apparatus, comprising: trays for accommodating discharge sheets; aligning means for aligning the sheets on said trays by urging edges of the sheets; driving means for driving said aligning means; supporting means for rotatably supporting said aligning means; and control means for controlling said driving means to change a degree of the urging of said aligning means in accordance with a size of the sheets accommodated in said tray.

According to another aspect of the present invention, there is provided an image forming apparatus, comprising: an image forming station; a sheet post-processing device having trays for accommodating discharge sheets; aligning means for aligning the sheets on said trays by urging edges of the sheets; driving means for driving said aligning means; supporting means for supporting said aligning means for rotation; and control means for controlling said driving means to change a degree of the urging of said aligning means in accordance with a size of the sheets accommodated in said tray.

According to a further aspect of the present invention, there is provided a sheet post-processing apparatus, comprising: trays for accommodating discharge sheets; aligning means for aligning the sheets on said trays by urging edges of the sheets; driving means for driving said aligning means; supporting means for movably supporting said aligning means; and control means for controlling said driving means to increase a degree of the urging of said aligning means in accordance with a number of the sheets accommodated in said tray.

According to a yet further aspect of the present invention, there is provided a sheet post-processing apparatus, comprising: trays for accommodating discharge sheets; aligning means for aligning the sheets on said trays by urging edges of the sheets; binding means for binding the sheets; driving means for driving said aligning means; supporting means movably supporting said aligning means for rotation; and control means for controlling said driving means to change a degree of the urging of said aligning means so that the degree is low when said binding means is in operation, and that it is low when it is not in operation.

When the sheets in the plural bins are aligned, the sheet urging degree is changed in accordance with the size of the sheet (sheet width), so that the sheets are urged by a constant urging force, and therefore, the sheets can be urged by the optimum conditions irrespective of the size and the number of sheets, without damage to the sheet ends.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
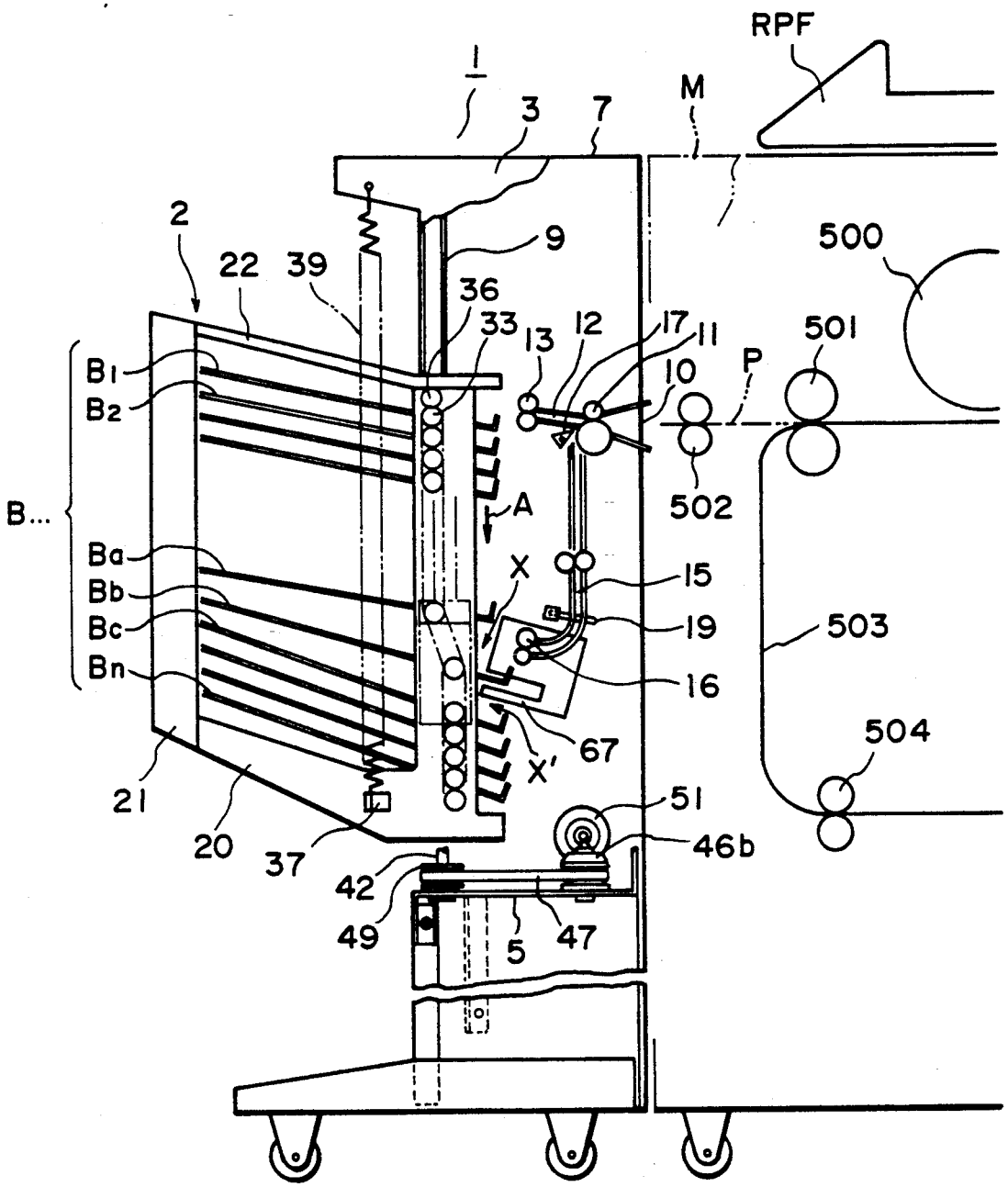
FIG. 1 is a longitudinal sectional view of a sheet post-processing apparatus according to an embodiment of the present invention.

A first embodiment of the present invention will be described in conjunction with the accompanying In FIGS. 1 and 3, the movable bin type sorter 1 (sheet post-processing apparatus) comprises a sorter main assembly 7 including a pair of side plates 3, a base 5 and a cover 6. The sorter 1 further comprises a bin unit 2 provided with a number of bins B1–Bn, and the bin unit 2 is substantially vertically movable along a pair of guide rails 9.

The sorter main assembly 7 is coupled with an image forming apparatus M at its upstream side (right side in FIG. 1) with respect to the direction of sheet movement, and the sorter 7 is provided with an inlet 10 for receiving a sheet P discharged from the image forming apparatus and a pair of receiving rollers 11. Downstream of the receiving rollers 11 to the bin unit 2, there are first sheet conveying passage 12 and upper discharging roller 13. Out of the upper discharging roller 13, a second sheet conveying passage 15 and a lower discharging roller 16 (sheet discharging means) 16 are branched. At the branch portions 12 and 15, there is a deflector 17 which is selectively movable to either direct the sheet to be discharged to the bin B from the upper discharging roller 13 to the first sheet conveying passage 12 or to direct the sheet to be discharged to the bin B from the lower discharging roller pair 16 to the second sheet conveying passage 15. The image forming apparatus comprises a document feeder RPF, a photosensitive drum 500, an image fixing roller 501, discharging rollers 502, sheet refeeding path 503, sheet refeeding roller 504 or the like.

Adjacent the sheet discharging portion for the second sheet conveying passage 15, there is a sheet sensor 19 for detecting the sheet P. The sheet sensor 19 is in the form of a photointerruptor type having a lead switch, but may be in the form of a transparent type. The sheet P discharged from the image forming apparatus M is detected by a discharge sensor of the image forming apparatus. In this embodiment, the sheet passing period and the interval between adjacent sheets can be measured. An operation circuit in the image forming apparatus produces a sheet discharge signal and sheet interval signal, and the signals are supplied to a microcomputer in the bin unit 2.

Figure 3:
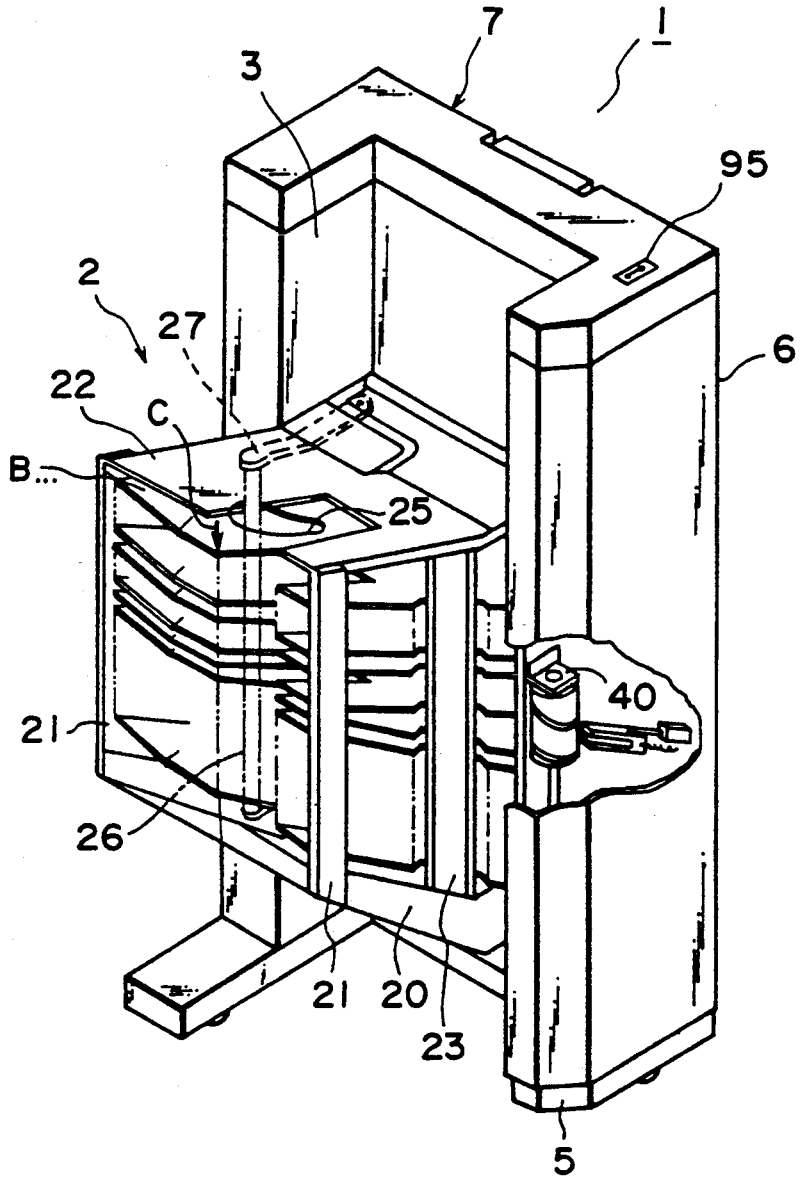
FIG. 3 is a perspective view of the sheet post-processing apparatus.
Figure 4:
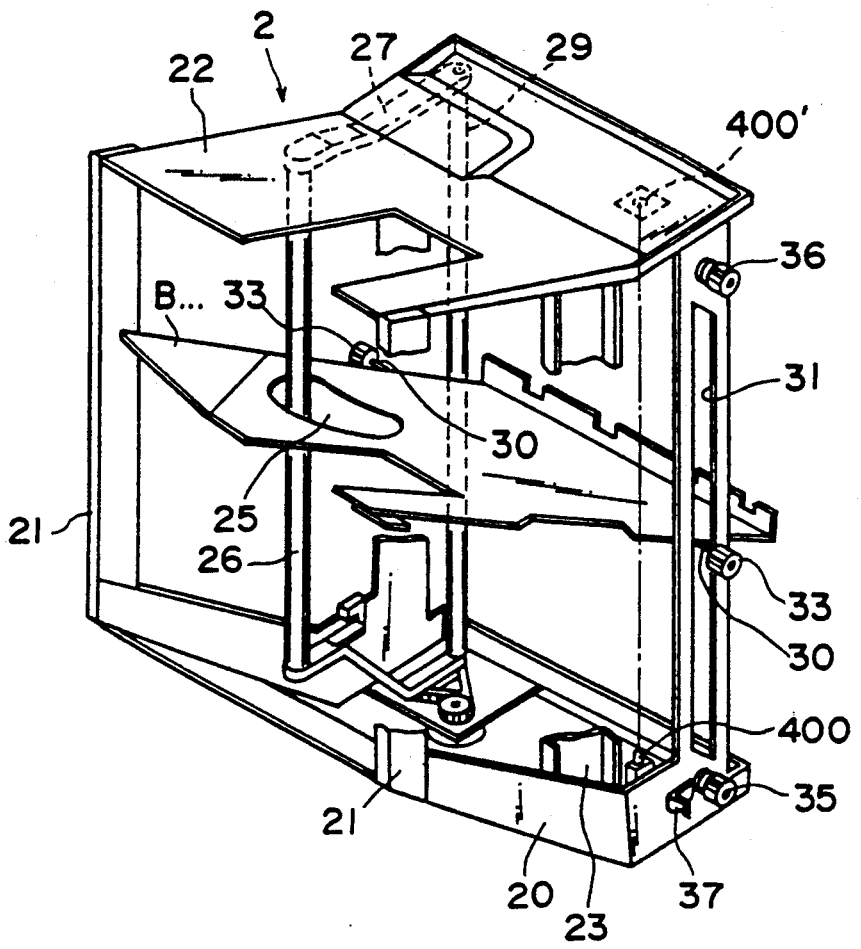
FIG. 4 is a perspective view of a bin unit.

As shown in FIGS. 3 and 4, the bin unit 2 has a pair of bin supporting plates 20 constituting a frame structure. To an end of the sheet supporting plate 20, a bin slider 21 is mounted, and a bin cover 22 is fixed to the bin supporting plate 20 and the bin slider 21. An alignment reference wall 23 is fixed to the bin cover 22 and the bin supporting plate 20. A recess 25 is formed in each of the bins B, and an aligning rod 26 penetrates through all of the recesses. The aligning rod 26 is supported by top and bottom aligning arms, and is swingable about a center rod 29 through the top aligning arm 27. The sheets P in each of the bins are aligned by the aligning rod 26 swinging to urge them to the reference wall 23.

Figure 5:
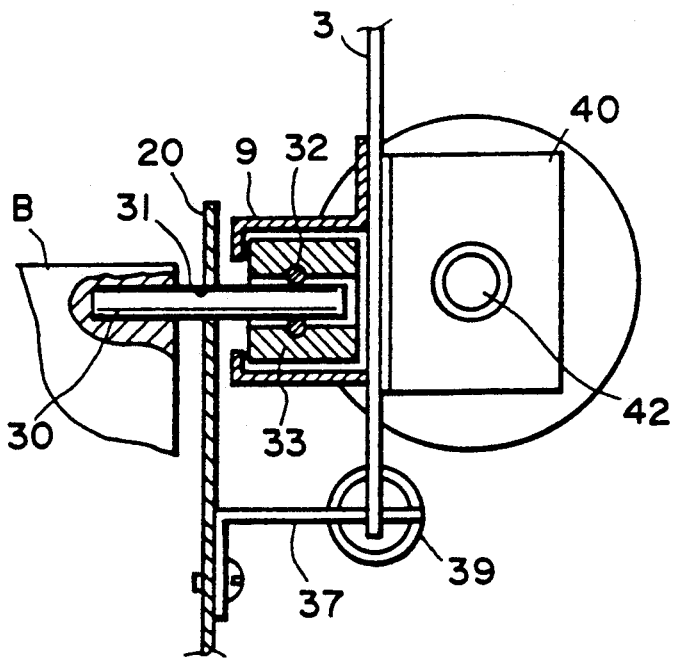
FIG. 5 is a longitudinal plan view in a cross-section of a lead cam and a trunnion.

Each of the bins B accommodated in the bin unit 2 has a free end where lateral ends thereof are movably placed in the grooves of the bin slider 21. As shown in FIG. 5, to the lateral ends of the base side of the bin slider 21, bins 30 are fixed. The bin 30 penetrates through a slit 31 formed in each of bin supporting plate 20, and to the outer end, a trunnion 33 is rotatably mounted through a buffer member in the form of an all-ring 32.

The trunnion 33 is engaged with the guide rail 9 so that plural trunnions 33 are stacked. The bottommost trunnion 33 is contacted to the lower guiding roller 35 rotatably supported on the bin supporting plate 20, and the topmost trunnion 33 is contacted to the top guide roller 36 rotatably supported on the bin supporting plate 20. The bins B are supported by the bin unit 2 so that the bin intervals are constantly equal to the outside diameter of the trunnion 33.

As shown in FIG. 1, the bin unit 2 is substantially vertically movable along the guide rails 9 with the top guiding rollers 36 and the bottom guiding rollers 35 engaged in the guide rail 9. Between the side plate 3 and a member 37 fixed to the bin unit 2, a tension spring 39 is stretched to provide the bin unit 2 with the upward force.

Figure 6:
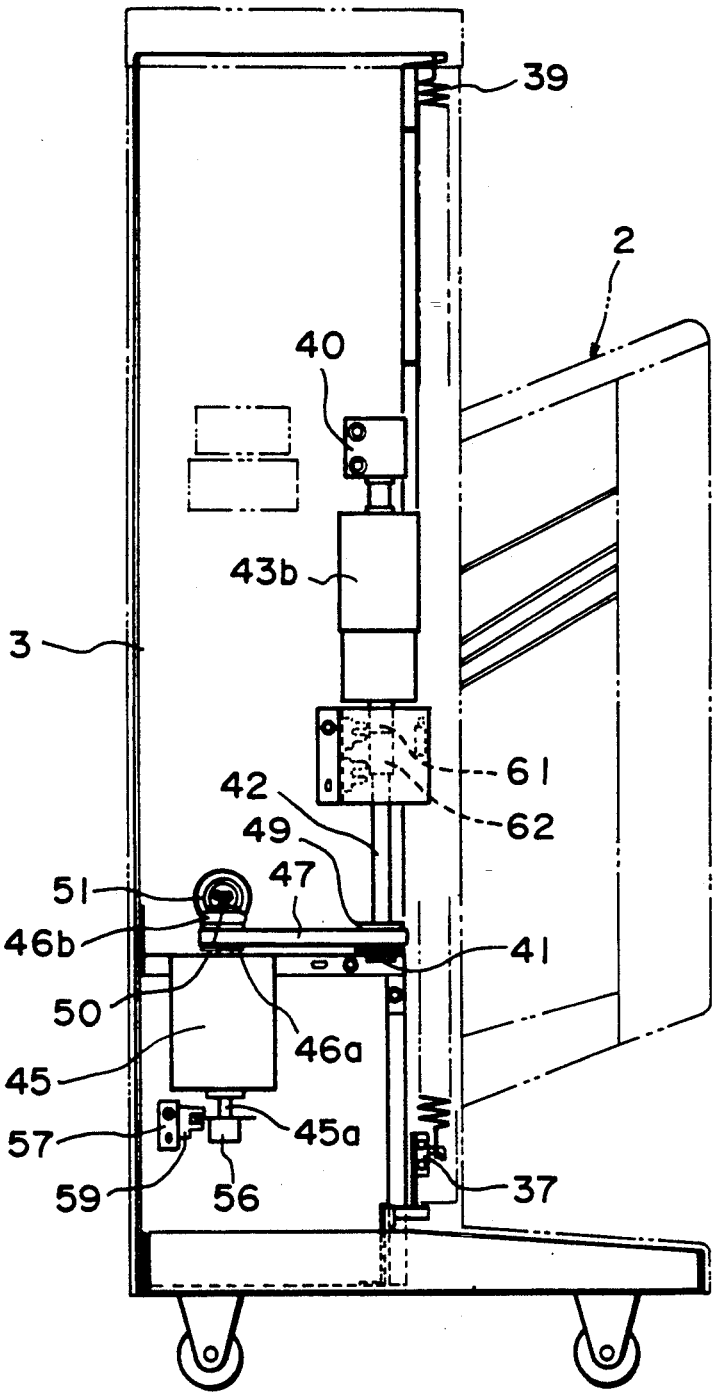
FIG. 6 is a longitudinal sectional view as seen from the opposite side as in FIG. 1.

At a position faced to the bottom discharging rollers 16 supported on the side plates 3 as shown in FIGS. 3 and 6, there is a camshaft holder 40. Between the camshaft holder 40 and the base 5, a lead camshaft 42 is rotatably mounted by bearings 41. Above the right and left lead camshafts 42, a pair of lead cams (helical cam means) 43*a* and 43*b* having helical cam surfaces are fixed.

Figure 10:
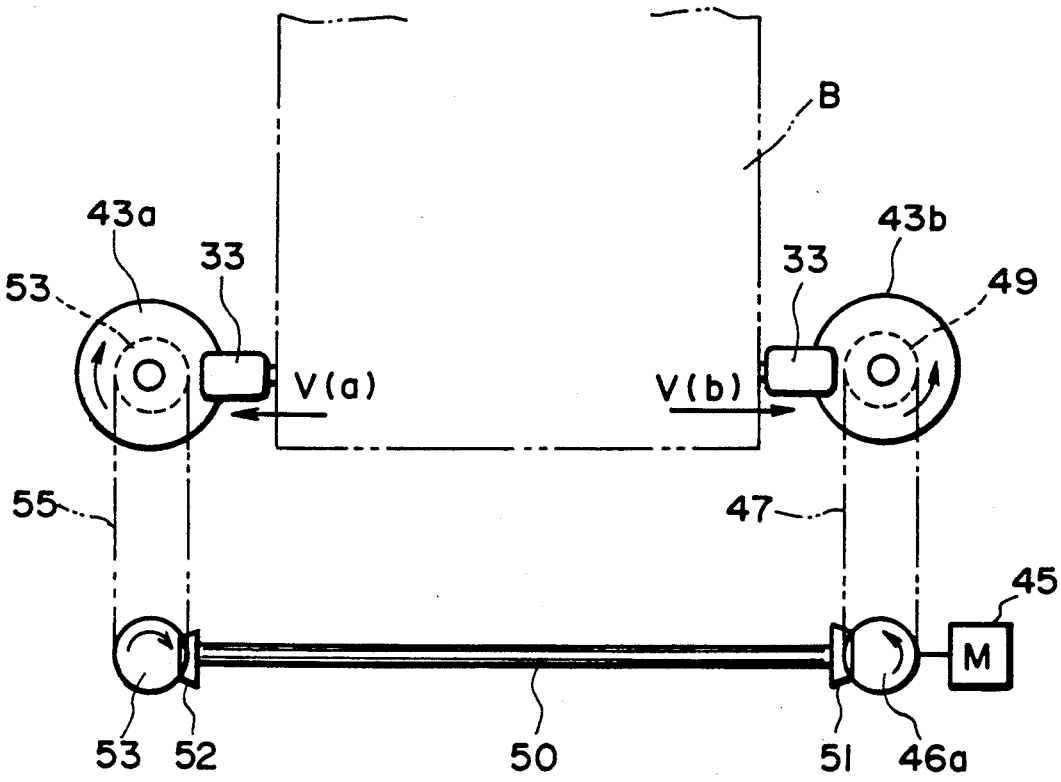
FIG. 10 is a top plan view of a driving system for the lead cam.

In FIGS. 6 and 10, a reversible shift motor 45 is fixed to one of the side plates 3. To an output shaft 45*a* thereof, a bevel gear 46*b* integral with a pulley 46*a* is fixedly mounted. The pulley 46*a* is coupled with a pulley 49 fixed on the lead camshaft 42 of the lead cam 43*b* by a belt 47. The bevel gear 46*b* is meshed with a bevel gear 51 fixed to an end of the penetrating shaft 50. A bevel gear 52 is fixedly mounted to the other end of the penetrating shaft 50, and is meshed with an unshown bevel gear integral with a pulley 53. As shown in FIG. 10, the pulley 53 is coupled with a pulley 53 fixedly mounted on the lead camshaft 42 of the other lead cam 43*a* by a belt 55. By the drive transmission system constructed in the manner described above, when the shift motor 45 rotates in the forward or backward direction, the lead cams 43*a* and 43*b* rotate in the direction indicated by an arrow or in the opposite direction, in FIG. 10.

To the other end (bottom end in FIG. 6) of the output shaft 45*a* of the shift motor 45, a clock disk 56 is fixedly mounted, and by an interrupter 59 supported on one of the side plates 3 through a sensor holder 57, the number of rotations of the shift motor 45, that is, the number of rotations of the lead cams 43*a* and 43*b* can be detected. By doing so, the number of rotations of the lead cams 43*a* and 43*b* can be controlled with the aid of a lead cam control circuit in the microcomputer of the sorter 1.

Figure 7:
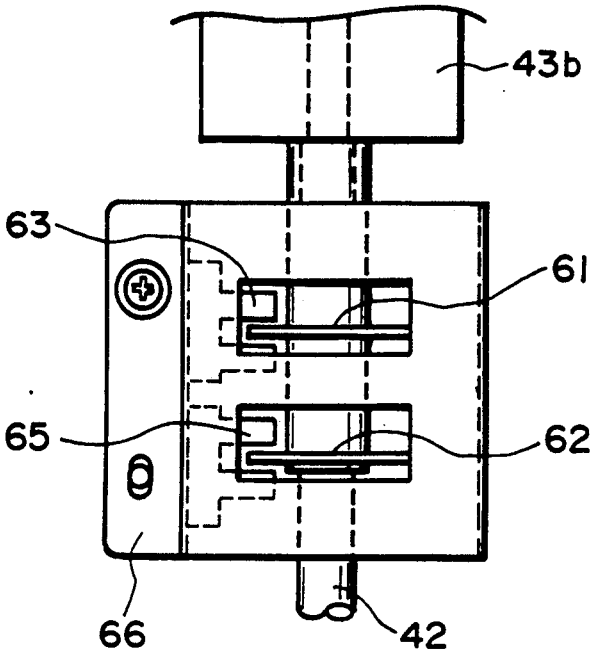
FIG. 7 is a side view of a flag of the lead cam.
Figure 8:
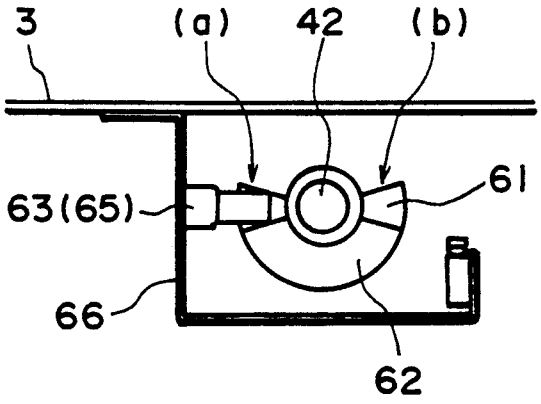
FIG. 8 is a top plan view thereof.

Below the lead cam 43*b* and along the axis of the lead cam 42, a pair of flags 61 and 62 are mounted to detect the positions of the lead cams 43*a* and 43*b*. FIGS. 7 and 8 are enlarged views thereof. In FIGS. 7 and 8, the interrupters 63 and 65 for reading the flags 61 and 62, are supported by a holder 66 fixed on the side plate 3.

The interrupters 63 and 65 have the same flag angle, but the phase is different by a predetermined amount. By the phase difference, the interrupters 63 and 65 rendered on and off, it is detected whether the bin B is at the upward home position or the downward home position, in the manner which will be described hereinafter.

The lead cams 43*a* and 43*b* have parallel portions (approximately 180 degrees), as will be described hereinafter. The phase differences of the flags 61 and 62 are determined corresponding to the parallel portion. In this example, the phase difference is approximately 30 degrees, and on the basis of the on and off states of the interrupters 63 and 65 due to the angle deviation of the flags 61 and 62, the positions of the lead cams 43*a* and 43*b* are discriminated.

The description will be made as to the operation of the bin B determined by the configurations of the lead cams 43*a* and 43*b* and the trunnions (bin rollers) 33 engaged therewith.

Figure 9A:
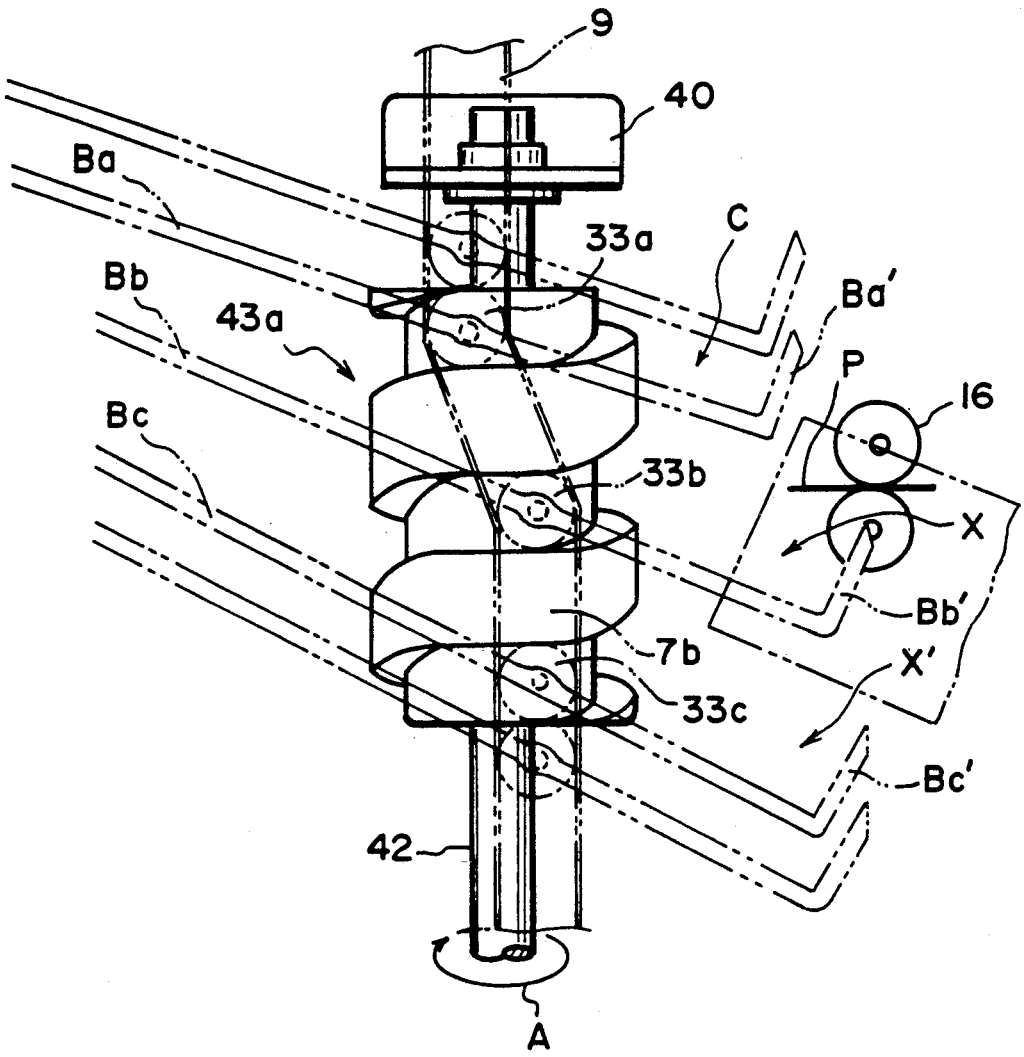
FIGS. 9A to 9D side view illustrating a relation between the lead cam and the bin.
Figure 9B:
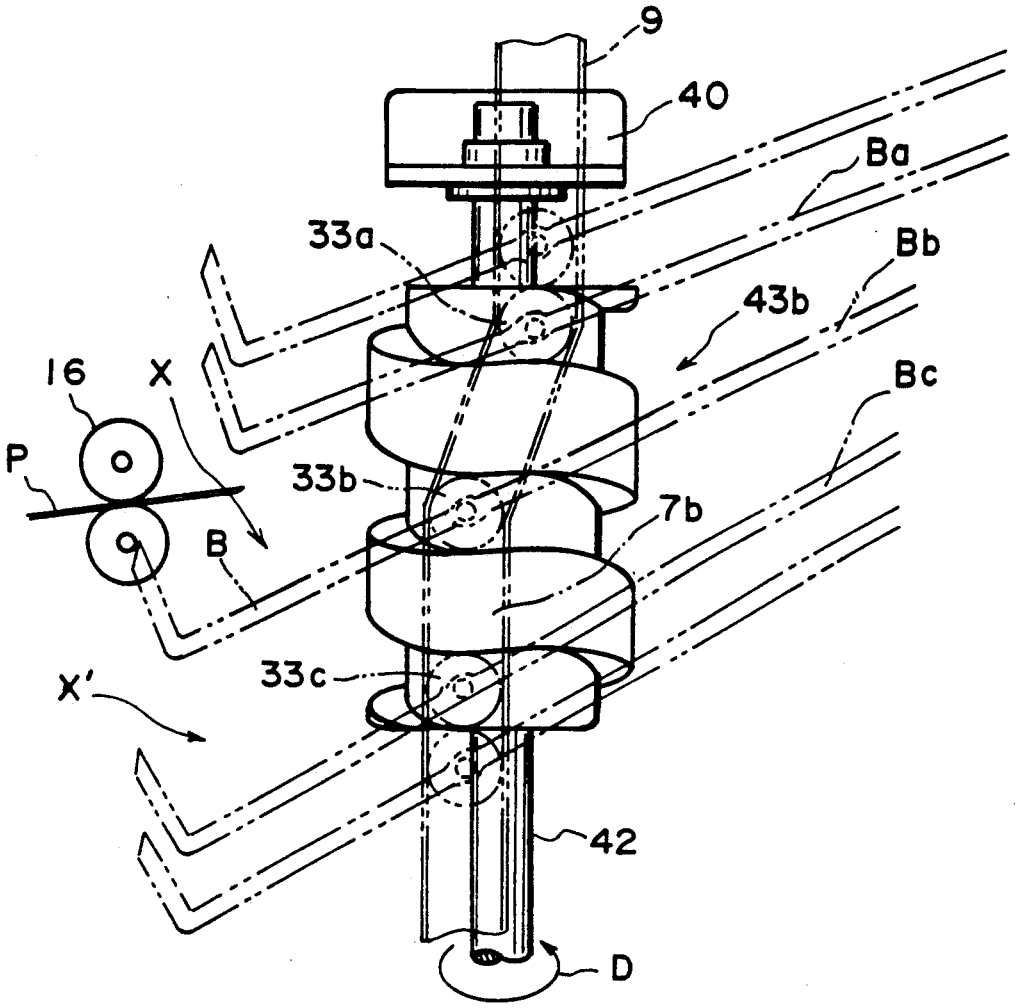
Figure 9C:
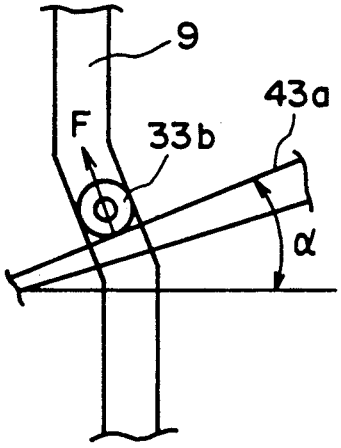
Figure 9D:
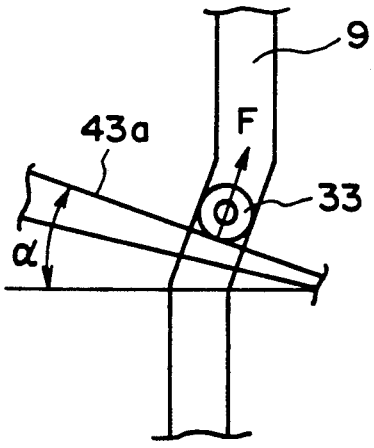

FIG. 9A shows the relation between the left lead cam 43*a* and the trunnion 43 and the bin B, and FIG. 10B shows the relation between the right lead cam 43*b* and the trunnion 33.

As shown in FIGS. 9 and 10, the lead cams 43*a* and 43*b* have helical configurations so as to provide opposite rotational directions, and therefore, the helical configurations are mirror-symmetric. In this embodiment, the bin intervals can be expanded at two positions X and X', and therefore, the helical configurations are provided by two leads. This is because of the provision of a sheet stapling mechanism 67 capable of entering bin intervals. If the apparatus has only the sorting function, only one expanding portion X for easily reception of the sheet is enough.

When the lead cams 43*a* and 43*b* rotate in the direction indicated by the arrow and the opposite direction by the shift motor 45, the trunnion 33 is urged to the groove and is guided along the guide rail 9 to move upwardly or downwardly. A part of the guide rail 9 shown in FIG. 9 is partly bent because the sorter 1 in this embodiment is provided with the sheet stapling mechanism 67, and therefore, the bin B is shifted frontrear direction (sheet movement direction). This structure is not limiting in the present invention.

The description will be made as to the alignment of the sheets P.

Figure 12A:
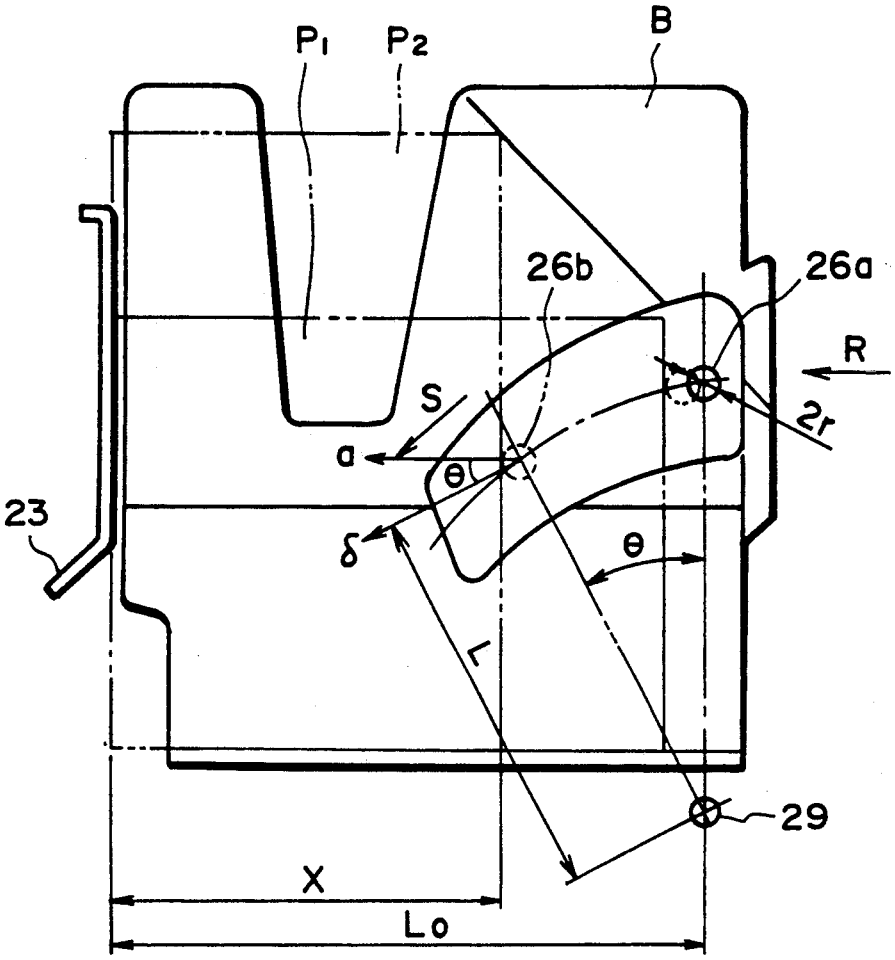
FIG. 12A is a top plan view of a sheet aligner having a sheet aligning reference wall and an aligning member.

FIG. 12 shows a top plan view of the bin unit 2. The reference wall 23 functions as an abutment reference, and the aligning rod 23 is movable along an arcuated path about the center rod 29.

Figure 11:
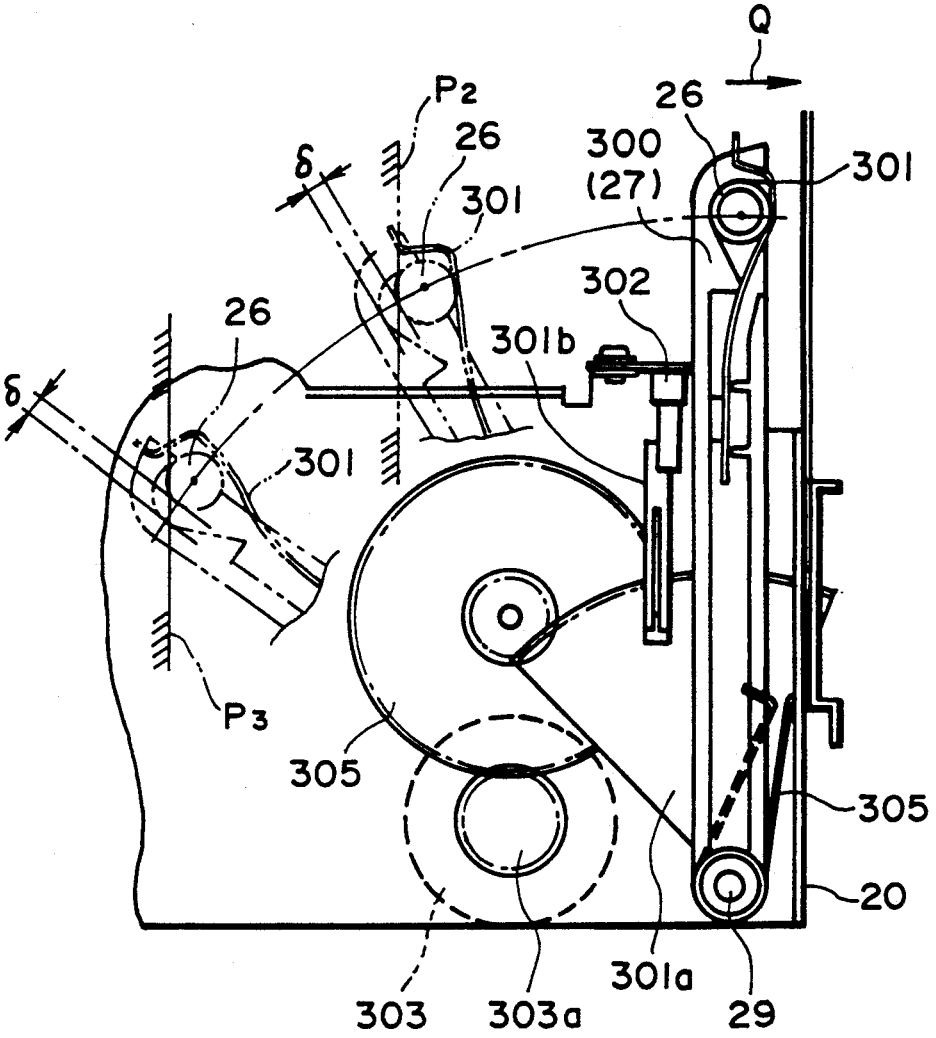
FIG. 11 is a top plan view of a bin unit driving system.

FIG. 11 shows a driving system is disposed to the bottom of the aligning rod 26 a bottom aligning arm 300 supports the aligning rod 26 with the aid of the top aligning arm 27. A leaf spring 301 is flexible in such a direction that the aligning rod 26 moves to the right in FIG. 11 relative to the aligning arms 27 and 300.

To a part of the bottom aligning arm 300, a sector gear 301*a* for driving the bottom aligning arm 300 and a flag 301*b* for detecting the home position of the bottom aligning arm 300, are integrally formed. Reference numeral 302, 303 and 305 designate a home position sensor, a stepping motor (driving source) and an idle gear. A coil spring 306 is hooked between a bin supporting plate 20 and a bottom aligning arm 300 to function to remove the play between the sector gear 301*a* and the idle gear 305 in one direction. Thus, the vibration resulting from the backlash when the switching between the forward and backward rotation by the stepping motor 303, is prevented, thus reducing the operation noise. It has been empirically confirmed that the vibration noise (chattering noise peculiar to the stepping motor) is reduced if the idle gear 305 meshed with the stepping motor gear 303*a* is made of relatively soft resin (elastomer having rubber property, for example, HIGHTOREL or the like).

Referring to FIG. 12, the positional relation between the aligning rod 26 and the reference wall 23 during the aligning operation will be described.

A sheet width x is 297 mm in the case of A4 size, and 210 mm in the case of A4R size. The sheet size is detected in this embodiment by the sheet size signal from the image forming apparatus. A distance X is a distance between an aligning wall 23 and an aligning rod 26 at the time of the sheet aligning operation.

A distance a of sheet P urging by the aligning rod 26 is (x−X). Usually, the sheet width is the same if the sheet size is the same. However, because of an unavoidable tolerance during the manufacturing, they are not exactly the same. Depending on the curled state of the copy sheet, the apparent sheet width is slightly reduced. Therefore, the aligning rod 26 is moved to such an extent that the distance X is smaller than the regular sheet width. In this embodiment, $$a=\delta\cos\theta \quad (1)$$

where $\theta$ is an angle of the aligning rod 26 relative to the home position 26*a* (an angle when the aligning rod 26 reaches the end of the sheet), and $\delta$ is a deflection of the leaf spring 301 in the direction Q in FIG. 11

In this embodiment, the sheet urging force by the aligning rod 26 is constant irrespective of the sizes of the sheet P. This is because if the urging force by the aligning rod 26 to the top and bottom aligning arms 27 and 300 is stronger than a predetermined level, the sheet edge is collapsed at the position contacted by the aligning rod 26. This is noticeable when the number of the sheets stacked is small. When the urging force of the aligning rod 26 is about the predetermined level, the proper urging force is provided to align the sheets P, and therefore, the sheets are properly aligned The deflection δ of the leaf spring 301 is $$\delta=(4Wl^3)/(bh^3E) \quad (2)$$

where W is the urging force, l is the length of the leaf spring 301, b is a width of the leaf spring 301, h is a thickness of the leaf spring 301, and E is the Young's modulus (depending on the material of the leaf spring).

In this embodiment, the value a (=δ) when A4 size (standard size) sheet P is aligned is set to be 1.5 mm approximately empirically The desired urging force W is empirically determined. From equation (1), the value a is smaller when the width of the sheet is smaller than that of A4 sheet (urging force W: constant). Here, the value δ is the deflection of the spring 301 when the sheets are urged by the desired urging force, if the number of the stacked sheets is large. If the number of the stacked sheets is small, the value δ is equal to the value a.

The angle of the aligning rod 26 as the function of the sheet size is obtained from $$X=L0-[L\cos(\pi/2-\theta)+r]:$$

$$\theta=\pi/2-\cos^{-1}[(L0-x-r)/L] \quad (3)$$

where L0 is a distance between the aligning wall 23 and the center rod 29, r is a radius of the aligning rod 26.

Therefore, the angle θ for a given size is calculated by the equation (3). From equation (1), the value a is calculated.

The distance X between the edge of the aligning rod 26 and the aligning wall 23 is $$X=x-a \quad (4)$$

therefore, the value X is determined.

From the value X, θ1 (θ+α) is determined. Then, the number of pulses to be provided by the stepping motor 303 is finally determined from θ1.

The reason why the urging degree of the aligning rod 26 is decreased with the decrease of the width of the sheet for the following reasons. When the arcuated aligning method is used as in this embodiment, and when the width of the sheet is large (A4, A3 or the like) as indicated by an arrow in FIG. 12, the sheet urging direction of the aligning rod 26 is generally the direction R which is substantially perpendicular to the reference aligning wall 23, and therefore, the sheets are substantially free from moment by the urging force. Therefore, the sheets stacked are not disturbed by the aligning urging force.

Figure 12B:
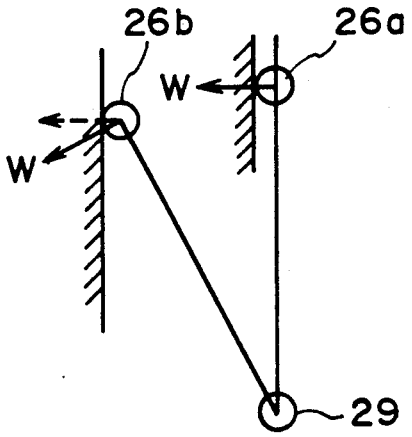
FIG. 12B schematically shows a direction of the urging force.

However, when the width of the sheet is small (A4R, B5R or the like), the urging direction of the aligning rod 26 is substantially a direction S, and is inclined with respect to the aligning wall 23, and therefore, the stacking sheet P receives a rotating force. If the urging force in the direction S exceeds a predetermined level (W), the alignment of the sheets is disturbed. In order to maintain the S direction urging force at the predetermined level, the urging degree in the perpendicular direction (component force) is decreased (FIG. 12B).

In the foregoing embodiment, the alignment is the arcuated movement type. However, in the case wherein the aligning rod or an aligning plate which translates in the direction perpendicular to the reference wall, the degree a of the urging is preferable for the purpose of improving the alignment performance. In the case of the translational aligning member, the degree a of the urging is not required to be changed in accordance with the width of the sheets.

The description will be made as to the movement of the aligning rod 26 during the stapling operation. After all of the copy sheets are discharged to the sorter 1 and aligned, they are automatically stapled in this embodiment. The stapling unit moves during the stapling operation from a retracted position 67X (FIG. 2), sheet stapling position 67Y, stapling operation, and back to the retracted position 67X. During the movement from the retracted position 67X to the stapling position 67Y, the aligning rod 26 keeps to urge the stacked sheets P to the reference wall 23.

This is because of the following. When the stapling unit enters above the stacked sheets P are moved by the upper unit and the lower unit of the stapler 67 through the upper paper guide 87 and the lower paper guide 90 without contact or with contact. In order to improve the alignment in the stapling unit entering period, the aligning rod 26 urges the stacked sheets P during the entering operation of the stapling unit.

During the stapling operation, the stacked sheets P are moved through a small distance by the urging force of the aligning rod 26. In order to minimize the variation of the stapling position by this small distance movement, the urging degree a' during the stapling operation satisfies relative to the above-described degree a of the urging during the aligning operation satisfies:

$$a \leqq a' (a' \text{ is close to } 0) \quad (6)$$

This is controlled by a control circuit. During the sheet alignment before the stapling, the aligning rod is separated after the urging action but in the case of the stapling operation, the urging by the aligning rod is continued, and therefore, if the urging force is strong, the sheets are deformed with the result of deviated stapling position.

The above structure (a is nearly equal to 0) is particularly desired in the case of the arcuated aligning system. In the case of the sheet alignment operation, when a small number of sheets, for example 20 sheets or smaller stack are on the bin B, the rigidity of the sheets P are not enough to resist the spring force by the leaf spring 301, so that the sheets P are waved by the urging force of the aligning rod 26, or the sheets are twisted by the moment in the direction S shown in FIG. 12. Therefore, the alignment during the stapling operation is not enough, or the stapling position is not proper.

If the number of sheets is more than 20 or the like, a certain level of urging force is required since otherwise improper sheet alignment may occur. In this embodiment, the stacks of sheets P on the plural-bins (not less than 10 bins) are aligned by one aligning rod, some degree a of the urging operation is required during the sheet alignment operation in consideration of the parallelism between the aligning rod 26 and the reference wall 23 over the range from the top to the bottom, the variation of the width of the sheets, the curling of the sheets in the bins.

During the stapling operation, in order to meet the variation in the stapling position upon the small width sheets (A4R or B5R, for example) stapling operation, the degree of the urging is a' to prevent the sheet P disturbance by minimum movement when the stapling unit enters. Preferably, the degree of the urging is a' upon the stapling, even for a large size sheet.

In another method, when the number of sheets to be aligned is small, the degree a of the urging is made smaller, and when the number exceeds a predetermined, the degree of the urging is increased (the number of the sheets may be discriminated on the basis of the signals provided from the main assembly or from the sorter). The predetermined number corresponds to the number of the sheets at which the force applied to the sheets by the aligning arm and the leaf spring is substantially equal to the rigidity of the entire stacked sheets. This applies to the translating type aligning means.

The description will be made as to the sheet discharge and the sheet alignment. The sheet P discharged from the image forming apparatus and received by the inlet 10 are discharged by the lower discharging rollers 16 in the sorting mode.

The bin B from which the sheets are discharged, is not moved relative to the lower discharging rollers 16. At this time, the lead cams 42*a* and 42*b* rotate, and the trunnion 33 passes the parallel portion.

The bin B from which the sheets have been discharged and to which the sheets are received detects the sheet discharge signal by the sheet sensor 19 in the forward sort mode in which the sheets are received while the bin unit 2 is moving from the bottom to the top. A predetermined period $t_1$ after passage of the trailing edge of the sheet P through the nip of the lower discharging rollers 16, the lower bin B having received the sheets is lifted and stopped at the position to expose the lower discharging rollers 16.

The bin Ba (FIG. 9) having received the sheets P is lifted by the inclined portions K of the lead cams 42*a* and 42*b*. Before the clearance C between the bin Bb and the bin B becomes as shown in FIG. 9A after completion of the shifting of the bin Ba, the aligning rod 26 presses the discharged sheets P to abut it to the reference wall 23, by which the aligning operation is completed. As regards the alignment timing, when the clearance C between the bin Bb and the upper bin B, becomes as shown in FIG. 9A after the completion of the shifting, the clearance C is larger than the thickness of the stack of the sheets P when the number of the sheets stacked is small Therefore, it is possible to confine the discharged sheets P. If, however, the number of sheets is large, particularly if the curling of the sheets is significant, it is possible that the thickness of the stack of the sheets is larger than the clearance C.

At this time, if the discharged sheets P are in the state as shown in FIG. 9A without being confined by the aligning rod 26, the entire sheets P are pressed between the bin B and the bin Bb. The sheets P which have already been aligned are no problem. However, the sheet P which has been discharged immediately before and which has not been pressed to the reference wall 23 is not aligned because of the load imposed between the sheets but is folded or partly collapsed. In view of this, the sheet P is aligned by the aligning rod 26 while the bin Bb is being lifted to the position of the bin Ba, that is, while the bin clearance C is still large.

In the case of the reverse sorting wherein the bin is lowered after receiving the sheet P, the sheet P is discharged to the bin Bb, as shown in FIG. 9A, and is moved to the position Bc. In this case, the sheet P is discharged; thereafter the bin Bb is moved to the position bin Bc; and thereafter, the sheet P discharged by the aligning rod 26 is aligned.

In the case of the lowering movement of the bin B, if the alignment is effected while the bin Bb is being moved to the position Bc with the angles of the bins Bb and Bc being different as shown in FIG. 9A, the sheets already stacked and aligned (during the alignment operation after the sheet discharge, the sheet already stacked are simultaneously urged by the aligning rod 26), may be pressed while the stacking angle of the sheets P is being changed (during the downward movement of the bin B), the alignment operation becomes improper In view of this, during the downward movement, the aligning rod 26 aligns the discharged sheets P after the bin Bb moves down from the position Bb to the position Bc.

The reason for the proper alignment is that when the sheets P on the bin B move down by the downward movement of the bin B, the sheet P may be confined; if this occurs, the weight of the sheet P caused the aligning rod 26 to be left at the reference wall 23 with the result of disturbance of the sheets. Upon the sheet alignment operation, the space D between the bins Bb and Bc is expanded, and unlike the upward movement period, a sufficient number of sheets can be stacked even if the curling degree of the sheet is large.

In a further embodiment, the bin Bb is first subjected to the alignment operation after the sheet discharge, and then is moved upwardly or downwardly. In the case of the forward sorting operation, it is moved to the position Bb in the forward sorting operation, and in the case of the backward sorting operation, it is moved to the position Bc. In this case, the alignment is satisfactory. In this case, if the alignment is not carried out after abutment of the trailing edge of the sheet P to the stopper B' of the bin B, the alignment quality is degraded by the moment applied by the aligning rod 26 (stacked with twist). Therefore, the alignment operation is carried out after the proper delay. Thus, the bin B is moved only after the sheet P is aligned, by which it is aligned with the sheets already on the bin. This is possible when the process speed and the time period corresponding to the sheet interval are long because of the nature of the image forming apparatus. If, however, the process speed is high or if the sheet interval is short (60 cpm or higher), the shifting with the delay does not meet such an image forming apparatus. Therefore, the structure as in this embodiment is preferable.

Referring to FIGS. 14–20 (flow charts), the operation of the present invention will be described.

Figure 15:
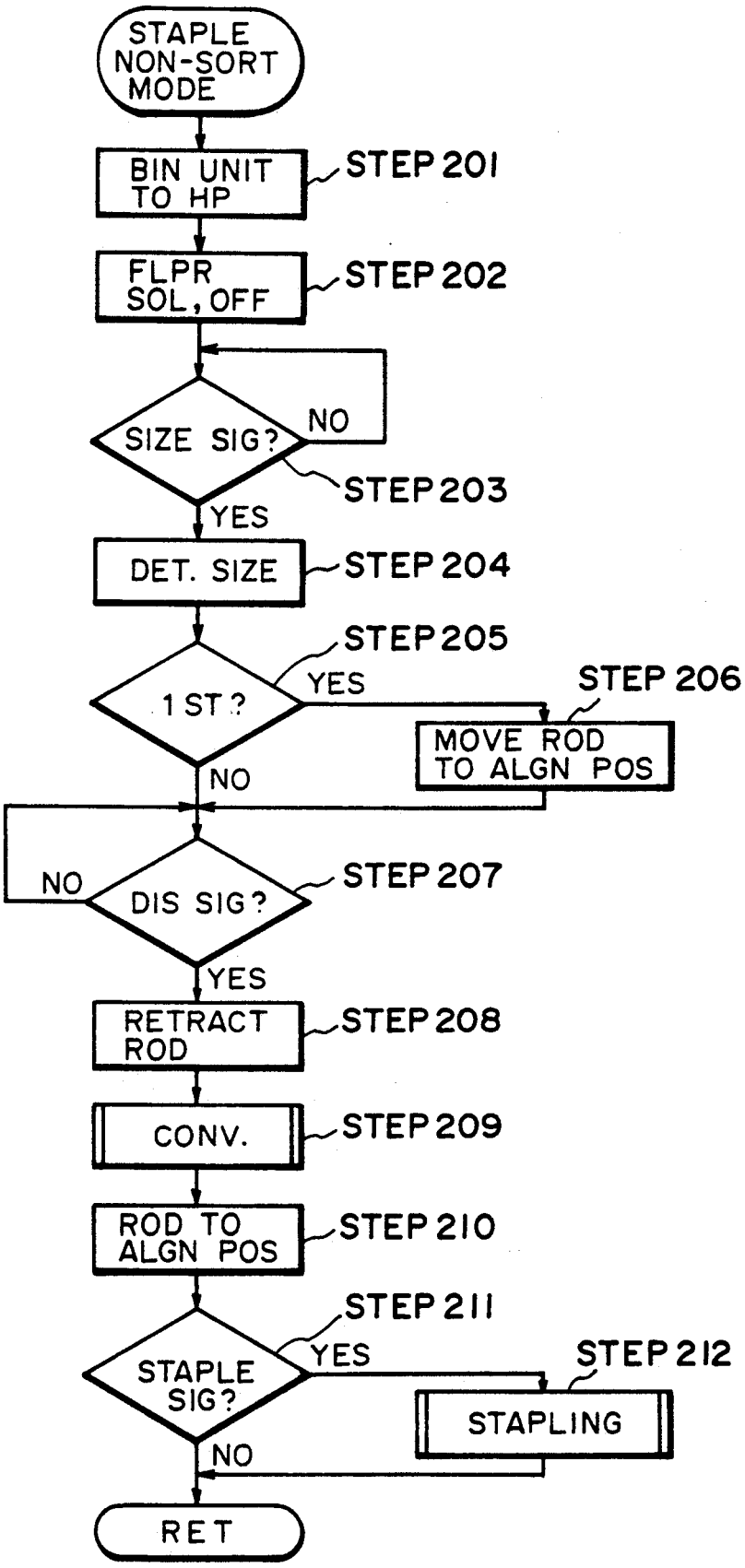

As shown in FIG. 15, when the copying operation is started by depressing the copy start key in the main assembly of the copying machine, a sorter starting signal is supplied in the form of a serial signal from the main assembly of the copying machine. The sorter 1 waits for this signal (step 101), and the operation proceeds to step 102 upon the production of the sorter start signal. At step 102, the operational mode for one job until the sorter start signal is completed is determined, and the mode data is stored in a RAM 113. In order to detect the position of the aligning rod 26, the aligning rod 26 is moved to the home position at step 103. Next, on the basis of the mode determined at the step 102, various operations are started. At step 104, the discrimination is made as to whether or not the selected mode is non-sorting mode or not. If the mode is the non-sort mode, the discrimination is made as to whether or not the stapling operation is to be carried out at step 105. When the staple operation is to be carried out, staple non-sort mode (step 107) is executed, and when the staple is not to be carried out, the non-sort mode is executed at step 108. At step 104, if the discrimination is not non-sort mode, the operation proceeds to step 106, where the discrimination is made as to whether or not it is sort mode. If so, the operation proceeds to step 109 (sort mode). If not, the group mode is discriminated, and the operation proceeds to step 110. After the completion of the operation in any of the modes, the operation proceeds to step 111 where the discrimination is made as to whether the sorter start signal remains or not, that is, whether the one job is completed or not. If there remains, the sort start signal, the discrimination is that the one job is not yet completed, and the operation returns to step 104. If there remains no sorter start signal, the completion of the one job is discriminated, and the operation returns to the first step 101.

If the discrimination at step 101 means that there is no sorter start signal, the operation proceeds to step 120 where the discrimination is made as to whether or not the door 97 of the stapler is opened. If it is closed, the operation proceeds to step 121 where the stapler 67 is retracted, and the operation returns to step 101. If the opening of the stapler door 96 is discriminated at step 120, the operation proceeds to step 122 where the presence of the staple is discriminated. If there is needles, the operation returns to step 101. If there is no staple, the stapler 67 is moved to its operating position (step 123), and the interlock mechanism for the staple cartridge 69 is released.

Referring to FIG. 15, the operation in the staple non-sort mode will be explained. The position of the bin unit 9 in the staple is the home position. At step 201, the bin unit 9 is moved to the home position. Here, the stapler (sheet binding mechanism) 67 is unable to staple the sheets stacked on the bin cover 22, and staples the sheets P accommodated in the bin B. Therefore, even if the mode is the non-sort mode, the sheets P are required to be discharged to the bin B if the staple mode is selected. Therefore, the flapper solenoid 122 is deenergized, and the sort discharging outlet (lower discharging roller couple) 16 is selected (step 202). Thereafter, the size determining signal is awaited at step 203. If the size determination signal is produced, the operation proceeds to step 204 where the size data from the main assembly of the copying machine are stored in the RAM 113. If the sheet is the first sheet discharged from the main assembly of the copying machine (step 205), the aligning rod 26 is supposed to be at its home position.

Therefore, the aligning rod 26 is moved to the aligning position **26*a* at step 206. At step 205, if the result of the discrimination is that it is not the first sheet, the operation proceeds to step 207 after completion of the movement of the aligning rod 26 to the aligning position 26*a* at step 206. At step 207, the discharging signal is awaited from the copying machine and when the discharging signal comes, the aligning rod 26 is moved from the aligning or lateral shifting position 26*a* to the waiting position 43*b*, and the sheet is discharged to the bin B at step 209**.

Then, the aligning rod 26 is moved to the lateral shifting position **26*a* to align the sheet at step 201. Then, the operation proceeds to step 211 where the discrimination is made as to whether or not the stapling signal is produced. If so, the stapling operation is carried out at step 211**. If not, the problem returns to the main routine.

Figure 16:
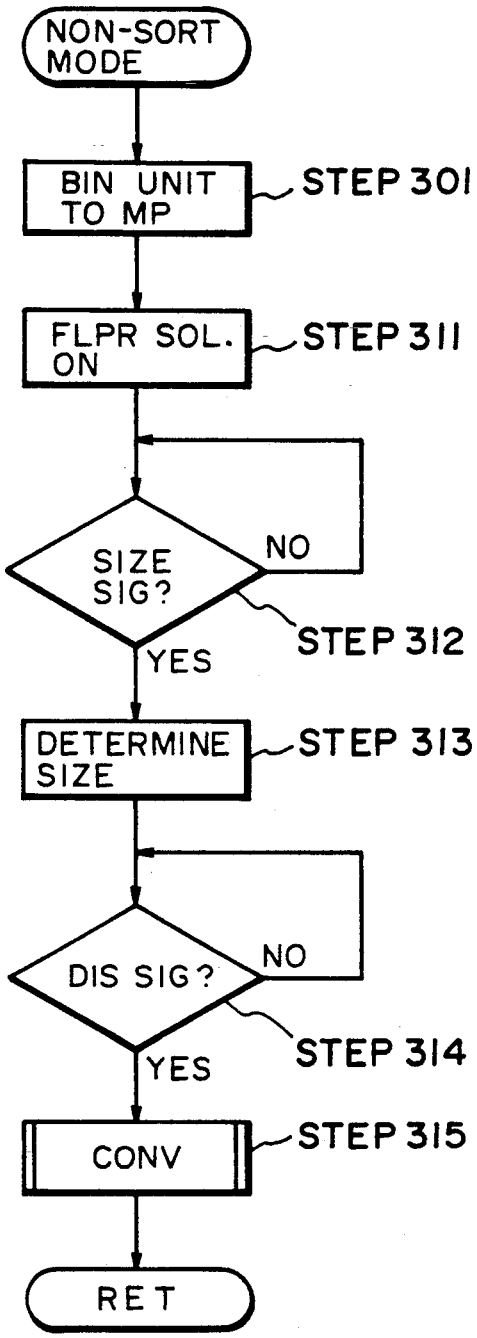

Referring to FIG. 16, the description will be made as to the operation of the non-sorting mode. In the non-sorting mode, the sheets are discharged onto the bin cover 22. Therefore, the bin unit 2 is shifted to its bottommost position (home position) at step 310, and the flapper solenoid 122 is actuated to permit the sheets to be discharged through the non-sort discharging outlet 15. Thereafter, the size determination signal is awaited at step 312. When the size determination signal comes, the size is determined at step 313, and the operation proceeds to step 314. At step 314, the sheet discharge signal from the main assembly of the copying apparatus is awaited. When the sheet discharging signal comes, the operation proceeds to step 315, by which the sheet is discharged to the bin cover 22, and the operation returns to the main routine.

Figure 17:
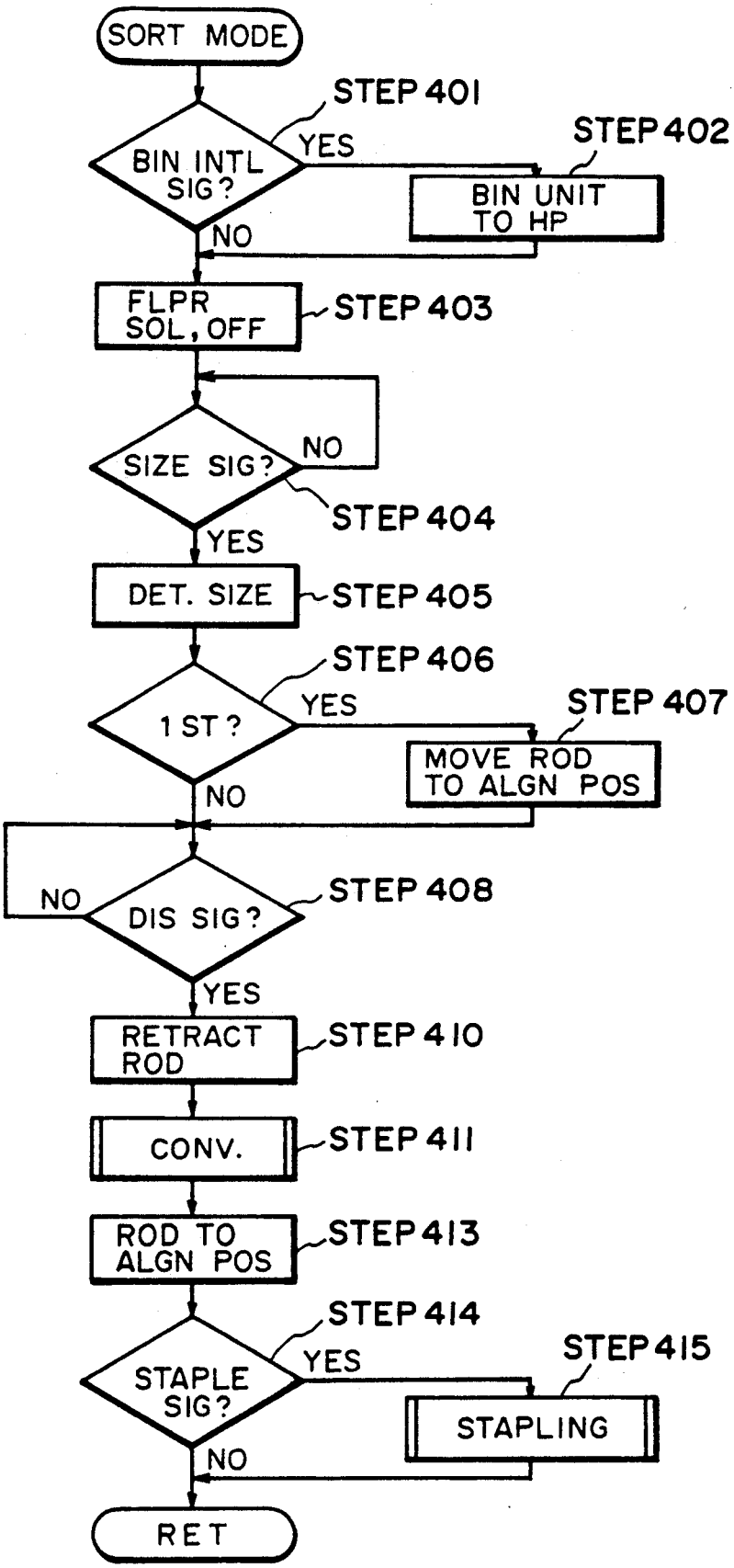

Referring to FIG. 17, the sort mode operation will be made. The discrimination is made as to whether or not the bin initial signal is produced (the bin initial signal being indicative of whether the bin unit 2 is to be returned to the home position or not), at step 401. Only if so, the bin unit 2 is moved to the home position at step 402. Then, in order to select the sort discharging outlet 16, the flapper solenoid 122 is deactuated at step 403, and the operation proceeds to step 404, where the size determination signal is awaited. When the size determination signal comes, the operation proceeds to step 405 where the size is determined. Thereafter, the discrimination is made as to whether it is the size determination for the first sheet at step 406. Only if it is the first sheet, the aligning rod 26 is moved to the lateral shifting position **26*a* at step 407, and the operation proceeds to step 408 where the sheet discharge signal from the main assembly of the copying machine is awaited. When the sheet discharging signal comes, the aligning rod 26 is moved to the waiting position 43*b* at step 410. Thereafter, the sheet is discharged to the bin at step 411, and the aligning rod 26 is moved to the lateral alignment position 26*a* at step 413, and the operation advances to step 414 where the discrimination is made as to whether or not the stapling signal is produced. Only if so, the stapling operation is carried out at step 415**, and the program returns to the main routine. The movement of the bins during the sorting operation will be described hereinafter.

Figure 18:
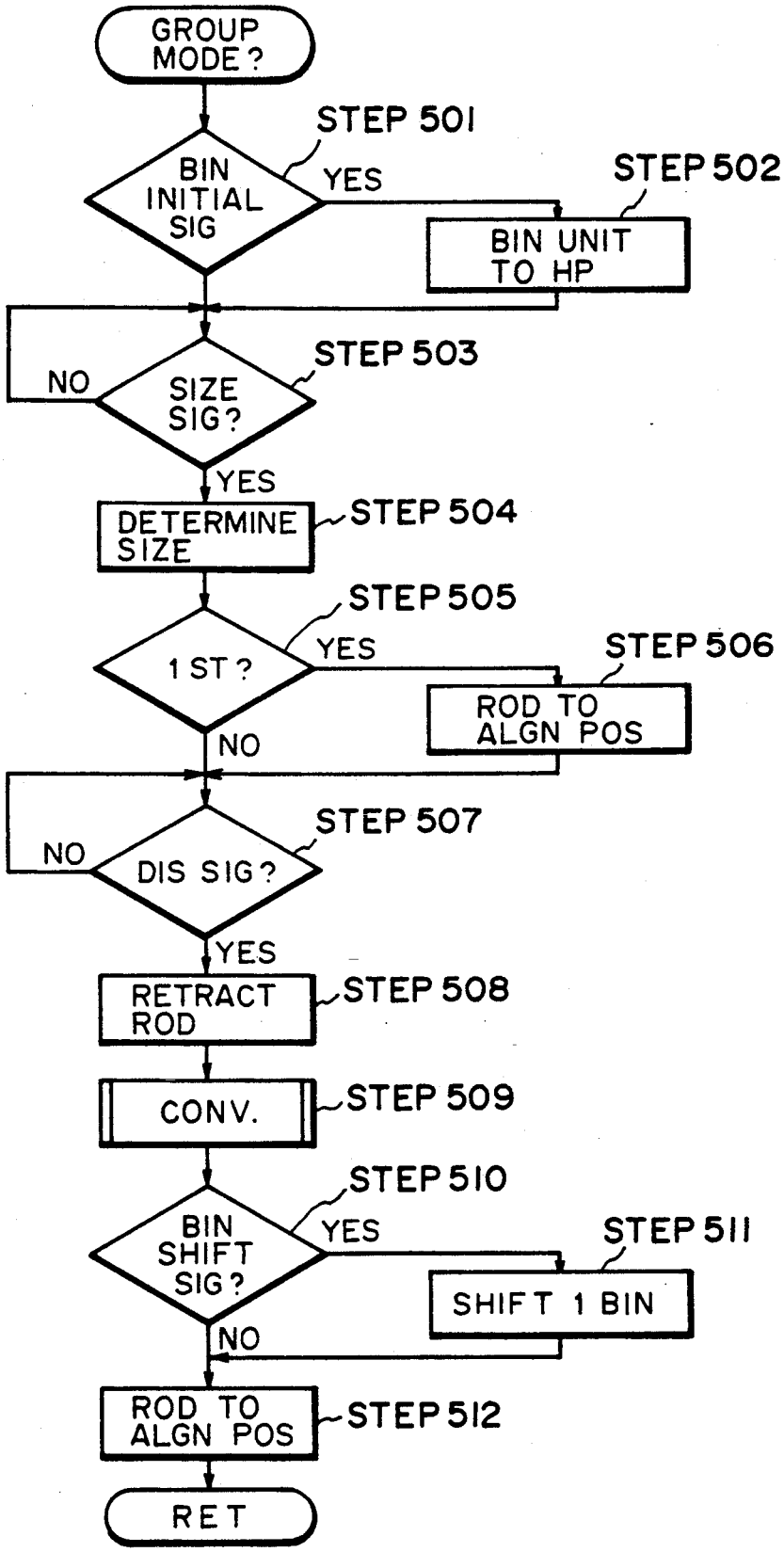

Referring to FIG. 18, the operation in the grouping mode will be described. The discrimination is made as to whether or not the bin initial signal is produced in the copying machine (main assembly) at step 501. Only if so, the bin unit 2 is moved to the home position at step 502. Then, the size determination signal is awaited at step 503. When the size determination signal comes, the operation of step 504 is executed in which the size is determined, and the discrimination is made as to whether or not it is the size determination for the first sheet at step 505. If so, the aligning rod 206 is moved to the aligning position **26*a* at step 506, and the operation proceeds to step 507. At step 507, the sheet discharging signal is awaited, and when it comes, the step 508 is executed in which the aligning rod 26 is moved to the waiting position 26*b*. Next, the conveying operation for conveying the sheet to the bin B is executed at step 509. After the completion of the conveying operation, the operation proceeds to step 510 where the discrimination is made as to whether or not the bin shifting signal is produced in the main assembly or not. Only if so, the bin is shifted by one bin at step 511. After the aligning rod 26 is moved to the aligning position 26*a* to align the sheet at step 512**, the operation returns to the main routine.

Figure 19:
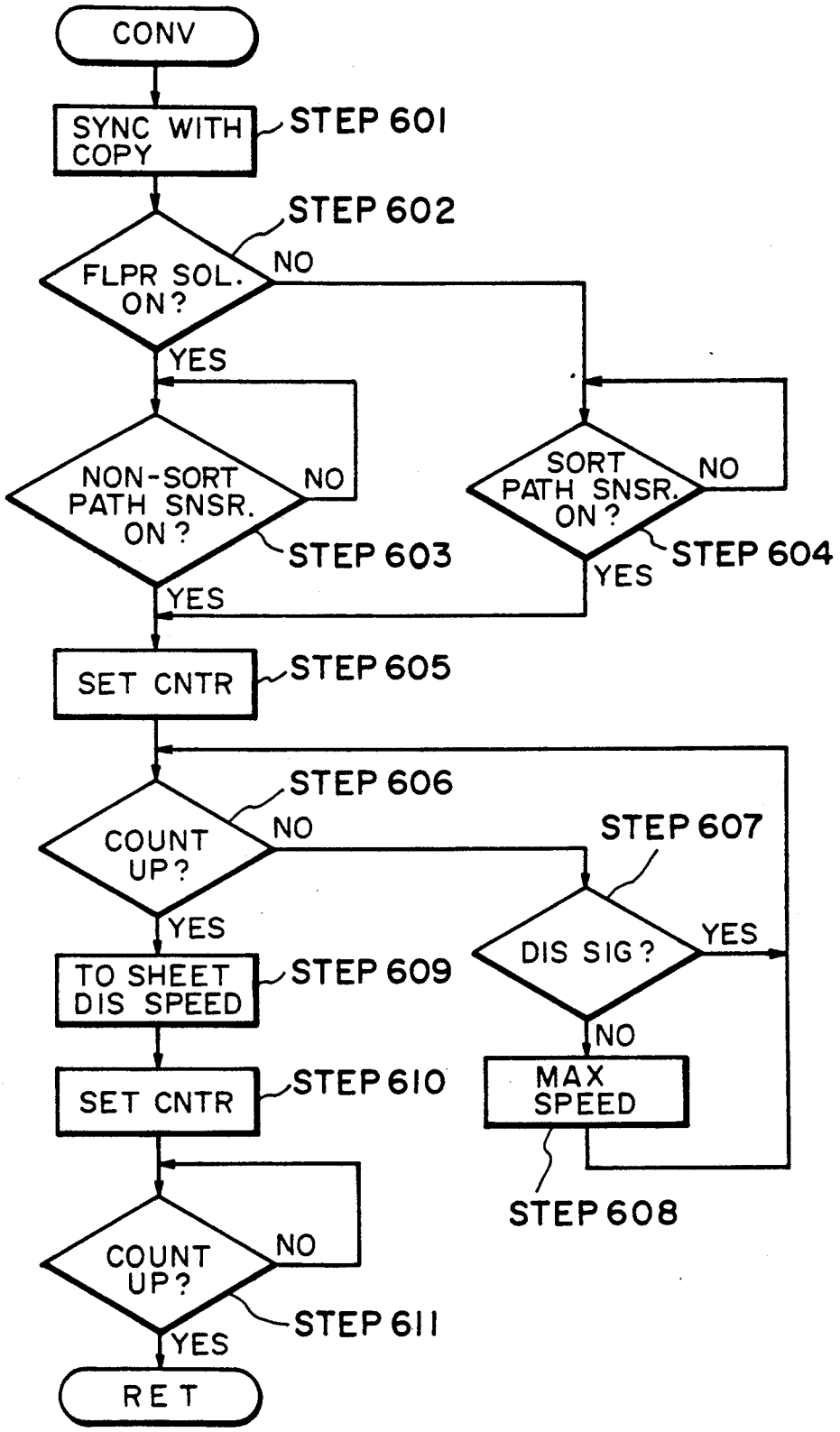

Referring to FIG. 19, the conveying operation will be described. In the conveying operation, when the sorter 1 receives the sheet from the copying machine, the sheet 1 is formed into a loop between the sorter 1 and the copying machine with the possible result of sheet jam, if the sheet conveying speed of the sorter 1 is slower than the sheet discharging speed of the copying machine. If, on the contrary, if the sheet conveying speed of the sorter 1 is higher than the sheet discharging speed of the copying machine, the sheet is stretched with the result of production of noise or tearing of the sheet. Therefore, the conveying speed of the sorter 1 is synchronized with the process speed of the main assembly of the copying machine.

Then, the discrimination is made as to whether or not the flapper solenoid 122 is actuated, that is, which of the sort discharging outlet 16 and the non-sort discharging outlet 15 is selected, at step 602. If the flapper solenoid 122 is actuated, it means that the non-sort discharging outlet 15 is selected and therefore, the operation proceeds to step 603 where the non-sort path sensor S1 is operated. If the flapper solenoid 122 is not actuated, it means that the sort discharging outlet 16 is selected, and the operation proceeds to step 604 where the sort path sensor S2 operates. At steps 603 and 604, actuations of the non-sort path sensor S1 and the sort path sensor S2 are awaited, respectively. After the actuations, the operation proceeds to step 605. At step 605, a counter for determining the position where the sheet discharge control of the conveying motor 117 is determined, is set. At step 605, the discrimination is made as to whether or not the counting operation of the counter is completed, at step 606. If it counts up, step 609 is executed, and if not, operation proceeds to step 607. At step 607, the discrimination is made as to whether or not the sheet discharging signal is produced in the main assembly of the copying machine. Only if not, it is determined that the sheet is completely away from the main assembly of the copying machine, and the conveying speed is changed to the maximum at step 608.

The step 609 is executed when the sheet discharging control point is discriminated at step 608, and the conveying motor 117 is controlled to be the sheet discharging speed of the copying machine. Thereafter, the counter for determining the sheet discharge completion point is set at step 610. When the counter counts up, the operation is terminated at step 611.

Figure 20:
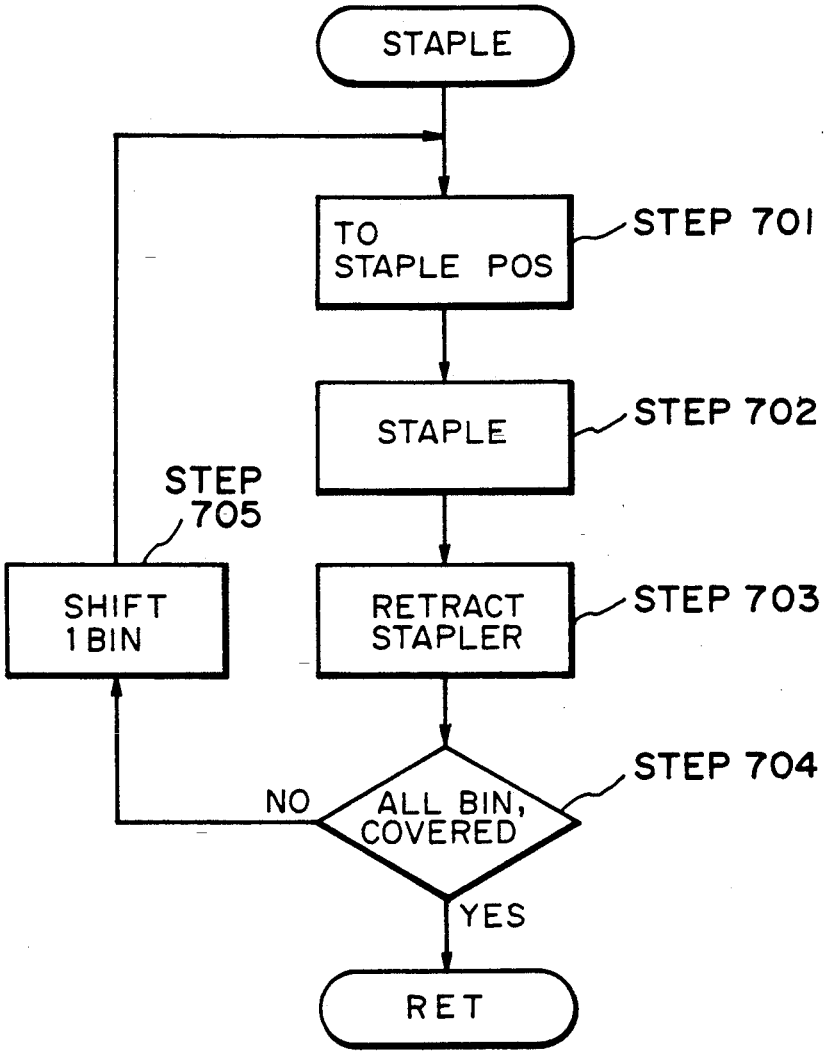

Referring to FIG. 20, the stapling operation will be described at step 701, the stapler swinging motor 119 is actuated to move the stapler 67, and the stapler swinging motor 119 is driven until both of the stapler operating position sensor S7 and the stapler positioning sensor S6 are actuated, that is, until the stapler 67 comes to the operating position 67*a*. Then, the stapler motor 71 is energized to effect the stapling action. That is, the stapler motor 71 is energized and then deenergized at a point of time where the stapler cam sensor S10 is actuated after it is deactuated, that is, until it rotates through one full turn, by which one stapling operation is completed at step 702. Thereafter, the stapler operating position sensor S7 is deactuated, and until the stapler positioning sensor S6 is actuated, that is until the stapler 67 moves to the retracted position 67*b*, the stapler swinging motor 119 is driven at step 703. Thereafter, the discrimination is made as to whether or not the operations are completed for all of the bins B. If not, the bin is shifted by one, at step 705. In order to effect the next stapling operation, the operation proceeds to step 701. If it is completed, the stapling operation is terminated.

Figure 21:
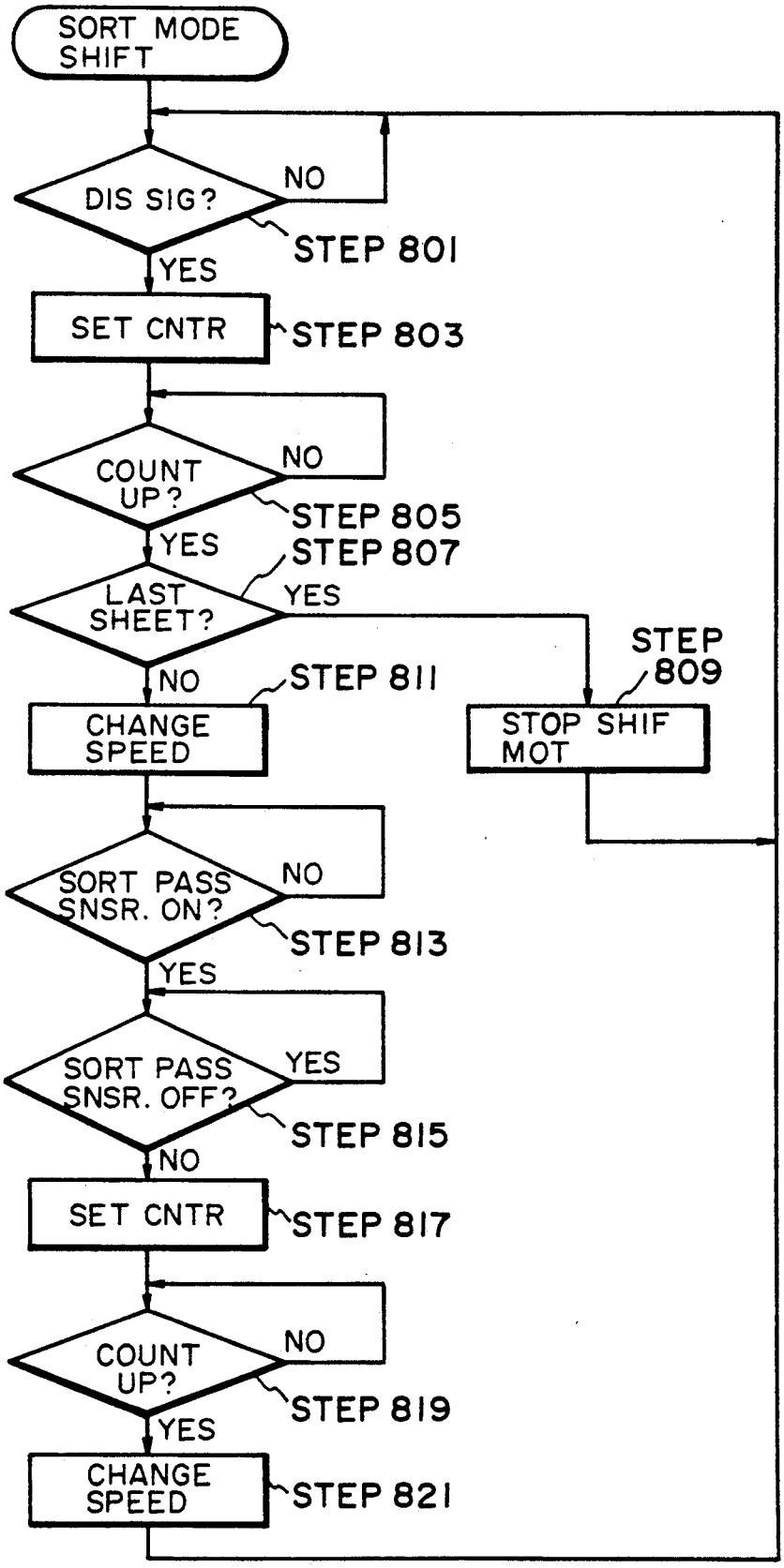

Referring to FIG. 21, the description will be made as to the shifting operation during the sorting mode which is one of the features of the present invention. In the shifting operation in the sorting mode, in order to synchronize the sheet P, the sheet discharging signal of the image forming apparatus is monitored at step 801. When the sheet discharging signal is produced, the instance when the leading edge of the sheet enters the bin B is timed with an end of the parallel portion of the lead cam 43. More particularly, a synchronizing counter is set at step 803. When it is counted up (step 805), the operation proceeds to step 807.

At step 807, the discrimination is made as to whether or not the transfer sheet is a final sheet of one set of originals. If so, the lead cam 43 is not advanced any further, and therefore, the lead cam 43 is stopped at step 809.

If it is not the final sheet, the program proceeds to step 811, and the speed of the lead cam 43 is changed. At this time, the speed of the lead cam 43 is determined by dividing the length of the parallel portion of the lead cam 43 by the time period determined by dividing the sheet length by the sheet conveying speed. As regards the sheet length data, they are supplied from the main assembly through serial communication shown in FIG. 13.

Thereafter, the programmed operation advances to step 813, where in order to detect the trailing edge of the sheet P, the actuation of the sort path sensor S2 is awaited. Thereafter, the deactuation of the sort path sensor S2 is awaited at step 815. Then, the counter is set to carry out the count from the detection of the trailing edge of the sheet (deactuation of the sort path sensor S2) to the completion of the accommodation of the sheet P in the bin B (step 817). If it is counted up at step 819, the operation proceeds to step 821.

At step 821, the speed is changed to the shifting speed in the interval between the sheets, and the speed is determined by dividing the non-parallel portion distance by the sheet interval. The sheet interval period is supplied from the main assembly of the copying machine through serial communication. After the determination of the shifting speed, the operation returns to step 801 for the purpose of processing the next sheet P.

Referring to FIG. 22, the speed control for the shifting motor 45 will be described. The control of the shift motor 45 is effected using the timer interruption function of the CPU 111 and the clock interruption function. The timer interruption function is the function by which the interruption is permitted with any interval by a hard counter in the CPU 111. The clock interruption function is the function by which the interruption is permitted in response to an edge of an external pulse. In this control, the clock interruption is carried out using a clock sensor S13 provided on an encoder of the shift motor 45.

The method of the control is as follows. The timer interruption interval is set to the clock interruption time when the shift motor 45 reaches the target speed. A counter is provided to detect the difference between the ideal time and the number of the clock interruptions, and the control is effected so that the count of the counter is zero, by which the ideal speed is established.

Figure 22A:
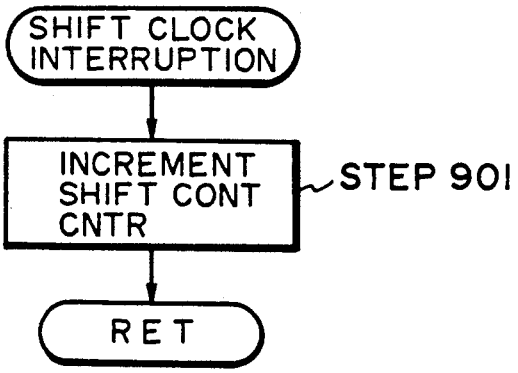
Figure 22B:
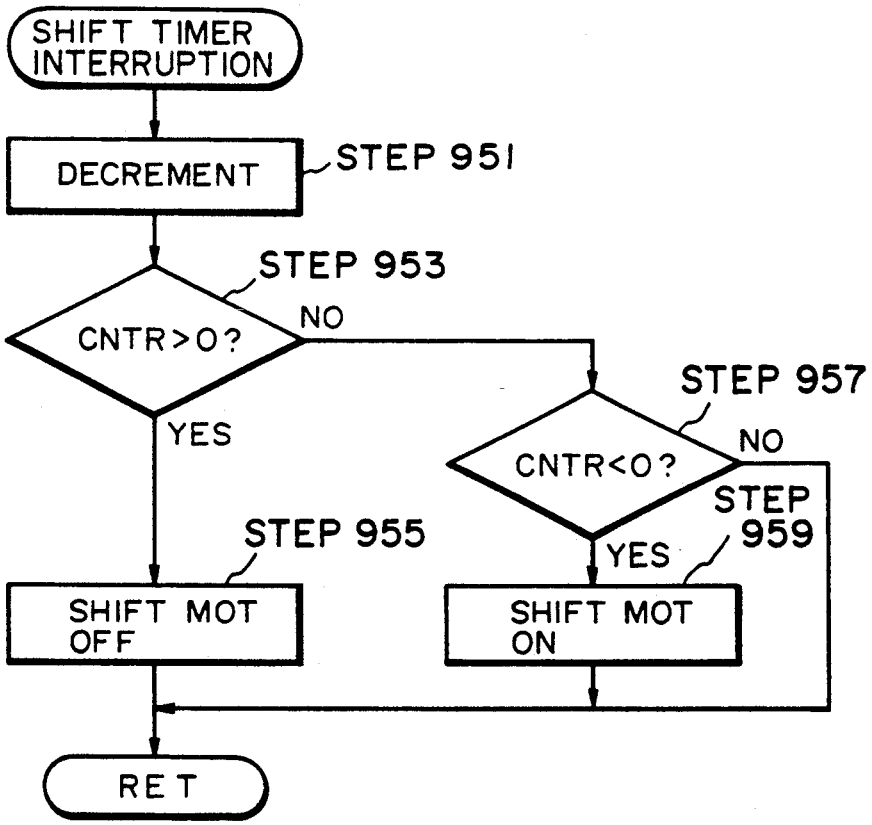

FIGS. 22A and 22B are flow charts for the above-described control. FIG. 22A shows the clock interruption process, and a shift control counter is incremented. The counter is set in the RAM 117.

FIG. 22B shows the timer interruption process. At first, the shift control counter is decremented at step 951 Next, the actuation or deactuation of the shift motor 45 is determined. To accomplish this, the discrimination is made as to whether or not the count of the shift control counter is larger than zero or not, at step 953. If so, the speed of the shift motor 45 is too high, and therefore, it is deactuated at step 955. If the shift control counter is equal to or less than zero at step 953, the discrimination is made as to whether it is less than zero or not at step 957.

If not, the count of the shift counter is zero, and therefore, the speed is the target speed, and the timer interruption is completed. If the count of the shift control counter is less than zero, the speed is lower than the target speed, and therefore, the shift motor 45 is actuated at step 959, and the timer interruption operation is completed. In the manner described above, the vertical movement of the bin unit 2 and the speed control of the shift motor 45 for expanding the clearance between the bins, are effected.

Figure 23A:
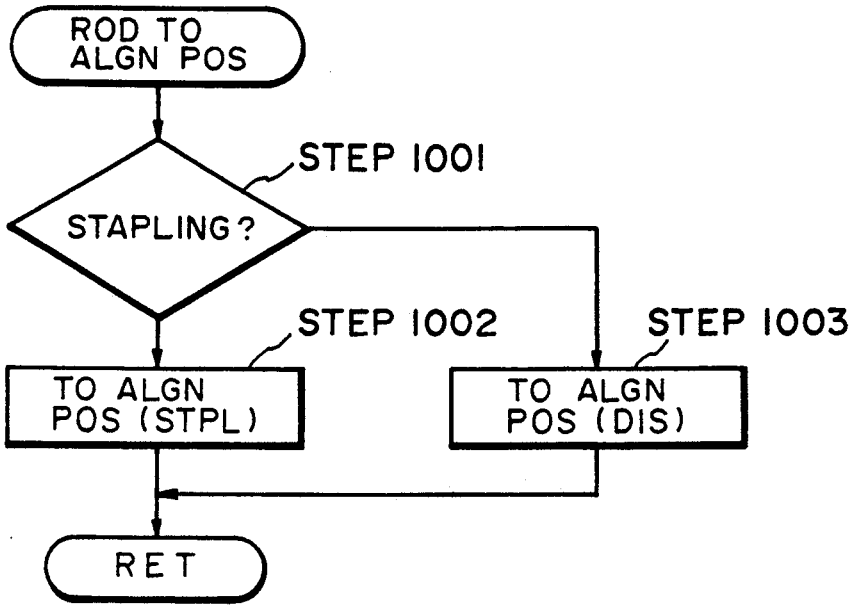
FIGS. 23A and 23B are flow charts of the sequential operations of the aligning member.
Figure 23B:
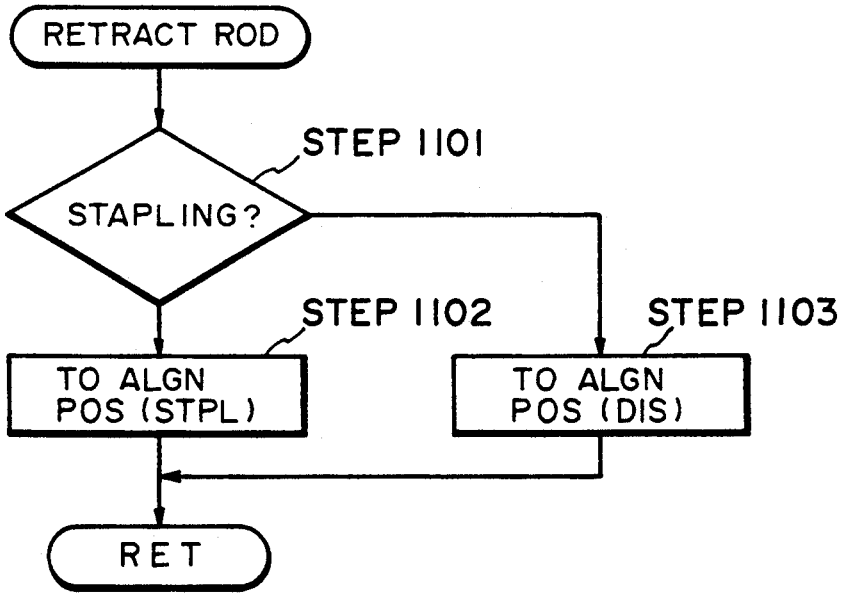

Referring to FIG. 23, the operation of the aligning rod 26 will be made. When the aligning rod 26 is moved to the lateral shifting position, the discrimination is made as to whether or not the stapling operation is being carried out, at step 1001. If so, the operation proceeds to step 1002 where the aligning rod 26 is moved to the lateral aligning position for the stapling. If not, the operation proceeds to step 1003, and the aligning rod 26 is moved to the lateral aligning position for the sheet discharging.

During the stapling operation, the aligning rod functions only to confine the sheets which have been once aligned, and therefore, the aligning rod 26 is moved to a position very close to the edge of the sheets. However, during the sheet discharging, a slight degree of the urging is desired in order to stabilize the aligning operation. The respective alignment positions are selected so as to satisfy the conditions, and the stepping motor 303 is controlled to provide the selected positions. When the aligning rod 26 is to be moved to its waiting position, the discrimination is made as to whether or not the stapling operation is being effected, at step 1101. If so, the operation proceeds to step 1102, and the aligning rod 26 is moved to the lateral shifting position for the stapling operation. If not, the operation proceeds to step 1103 where the aligning rod is moved to the aligning position for the sheet discharging operation.

During the sheet discharging operation, the sheet P is discharged away from the alignment reference wall 23, and therefore, in order to avoid the sheet P abuts the aligning rod 26, the aligning rod 26 is away to a substantial extent. However, during the stapling operation, the sheets are close to the aligning reference wall 23 after being aligned, and therefore, the aligning rod 26 is not required to be away to such an extent. In view of this, the movement distance of the aligning rod 26 is reduced to increase the aligning speed. The aligning rod 26 for aligning the sheet P is controlled in the manner described above.

In the foregoing embodiment, the urging force of the aligning rod during the stapling operation is smaller than that during the sheet aligning operation, by which the disturbance of the stapling position of the stapler 67 is avoided. However, it is an example of a possible alternative that during the entering of the staple unit to the sheets, the aligning rod 26 confines the sheet edges only when the stapler 67 is moved from the retracted position 67X to the sheet stapling position 67Y, and immediately before the operation of the stapler 67, the aligning rod 26 is retracted from the sheet edges.

Figure 24A:
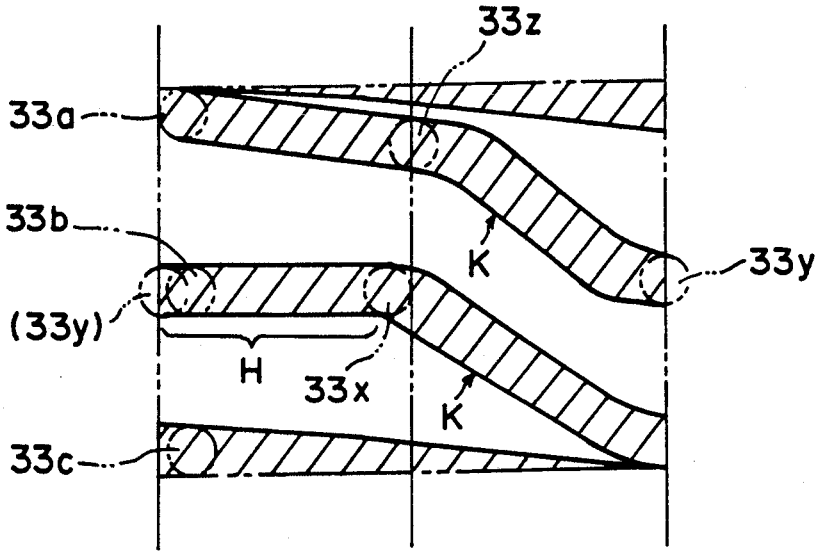
FIGS. 24A and 24B are cam diagrams of the lead cam.
Figure 24B:
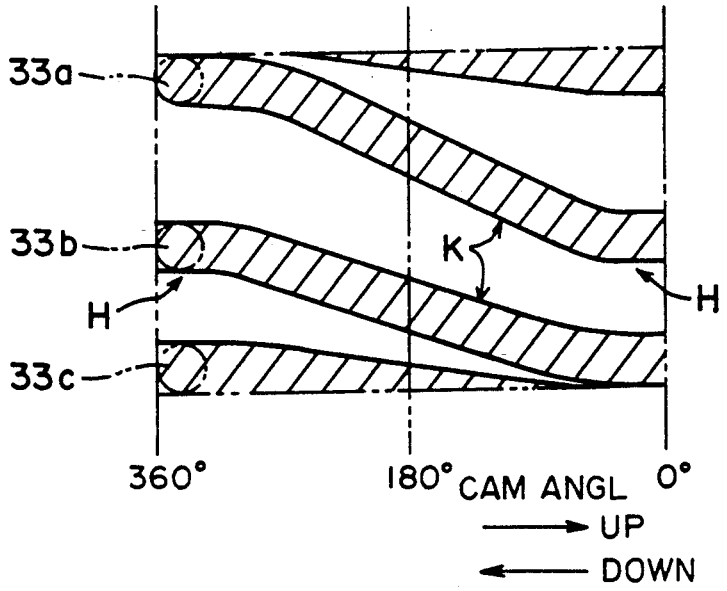

FIG. 24A shows a cam diagram of the lead cam 43*a*, and FIG. 24B is a cam diagram for a conventional lead cam. In the Figures, the hatched portions correspond to cam grooves of the lead cam 43*a*. The cam diagrams of FIGS. 24A and 24B are both for the left side cams with respect to the sheet conveying direction. The cam diagrams for the other lead cams 43*b* are of mirror symmetry. The cam diagrams cover the range of 0–360 degrees. In this embodiment, the cam is double-threaded, the therefore, the cam diagram shows the double threaded cams.

The positions of the trunnion 33 in the grooves of the lead cam 43*a* are indicated by references 33*a*, 33*b* and 33*c*. The position indicated by reference H in FIG. 25 corresponds to the parallel portions of the lead cam 43*a*, which extend through approximately 180 degrees in this embodiment. In the cam diagram, when the lead cam 43*a* inclines to the right, that is, when the lead cam 43*a* rotates in the direction indicated by an arrow in FIG. 24 (the trunnion 33 moves to the left), the bin B is lifted. When the lead cam 43*a* is inclined toward the left (the trunnion 33 is moved to the right), the bin B lowers. The parallel portion H shows the sheet discharge position of the lead cam 43*a* and the inclined portion K designates the shifting position.

When the sheet P is discharged by the lower discharging rollers 16 in FIG. 1, the parallel portion H substantially flush with the direction of the lead cam 43*a* is used, and therefore, the home position when the trunnion 33 is raised is a position 33X. The home position when the trunnion 33 lowers is a position 33Y. The phase difference between the home position 33X and the home position 33Y is 180 degrees as shown in FIG. 24A, in this embodiment. The positions 33X and 33Y of the lead cam 43*a* corresponds to flag regions (a) and (b) in FIG. 8.

The number of revolutions R1 (rpm) of the lead cam 43 is $$R1=(60\theta)/(2\pi t_1) \quad (1)$$

where $2\pi$ (radian) corresponds to one full circle of the lead cam 43 (43*a*, 43*b*), $\theta$ is the angle (radian) of the parallel portion H, $t_1$ is the time required for the sheet P passing through the discharging roller couple 16.

Therefore, the rotational speed of the lead cam 43 (process speed) increases with decrease of the sheet discharging period.

The number of revolutions R2 (rpm) of the lead cam 43 in the rest range $(2\pi-\theta)$, that is, the inclined portion of the lead cam 43a is $$R2=(60(2\pi-\theta))/(2\pi t_2) \quad (2)$$

where $t_2$ is the sheet interval (time) between adjacent sheets when the sheets are continuously discharged from the image forming apparatus.

By so determining, the one full rotation of the lead cam 43 meets the sheet discharge plus sheet interval Here, if the angle of the parallel portion H of the lead cam 43 is set so as to satisfy R1=R2, the rotational speed of the lead cam 43 is theoretically is equal during the sheet discharging and during the sheet interval Then, it is possible to shift the bin while rotating the lead cam 43 and while receiving the sheet P. That is, it becomes possible to accomplish the sheet sorting function for the sheets discharged from an image forming apparatus with the constant speed rotation of the lead cam 43.

If the image forming apparatus is a high speed apparatus, the time $t_2$ is small. In this case, a two-speed control (R1 to R2) may be used. By doing so, the lead cam 43 is not required to stop even if the speed thereof is not constant. This is advantageous because the noise can be reduced In the conventional apparatus, the noise has been produced by the impact resulting from the inertia of the bin unit upon start and stop of the lead cam rotation in a movable bin type sorter.

As an additional feature of this embodiment, it is suitable for a higher speed copying machine (high productivity copying machine). If the angle for the parallel portion H of the lead cam 43 is modified (more than 180 degrees, for example), the rotational angle of the lead cam 43 in the sheet interval is decreased Therefore, even if the rotational speed of the lead cam 43 is fairly lowered, it can meet the high speed (high productivity) machine, having the speed higher than that in the conventional copying machine.

In addition, the on-off control (start and stop) for the bin unit which has a large mass, is not required, and therefore, the power consumption for the copying machine can be saved.

Figure 32:
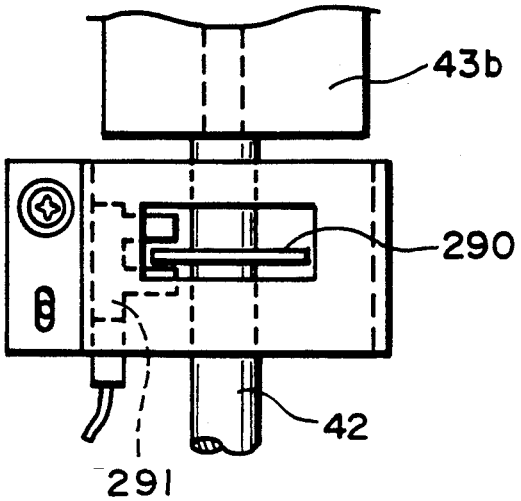
FIG. 32 is a side view of a modified lead cam detector.
Figure 33:
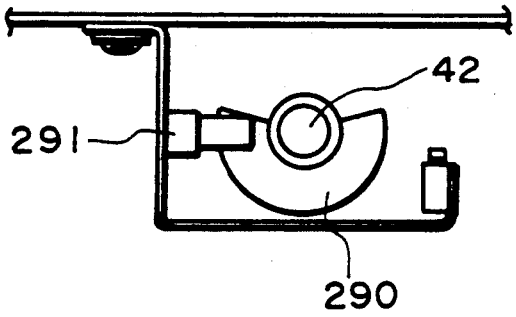
FIG. 33 is a top plan view thereof.

The lead cam flag in this embodiment has two flag structure (61, 62). However, it is a possible alternative that to use one flag 290 and one interrupter 291 as shown in FIGS. 32 and 33 corresponding to the parallel portion H of the lead cams 43*a* and 43*b*.

In this case, the discrimination whether the bin B is at the home position for the upward movement or the home position for the downward movement, can be made using the microcomputer (not shown) after the completion of the operation. If the power supply is shut by which the positional information relating to the lead cams 43*a* and 43*b* is cleared, the lead cams 43*a* and 43*b* are rotated by a small amount (initialing). The discrimination is made as to whether the interruption 301 becomes OFF (ON) or it remains ON (ON). By doing so, the position of the lead cams 43*a* and 43*b* can be discriminated. If the position detecting sensor of the bin unit 2 is ON, the discrimination is possible as to whether or not it is the home position of the bin unit 2.

Figure 2:
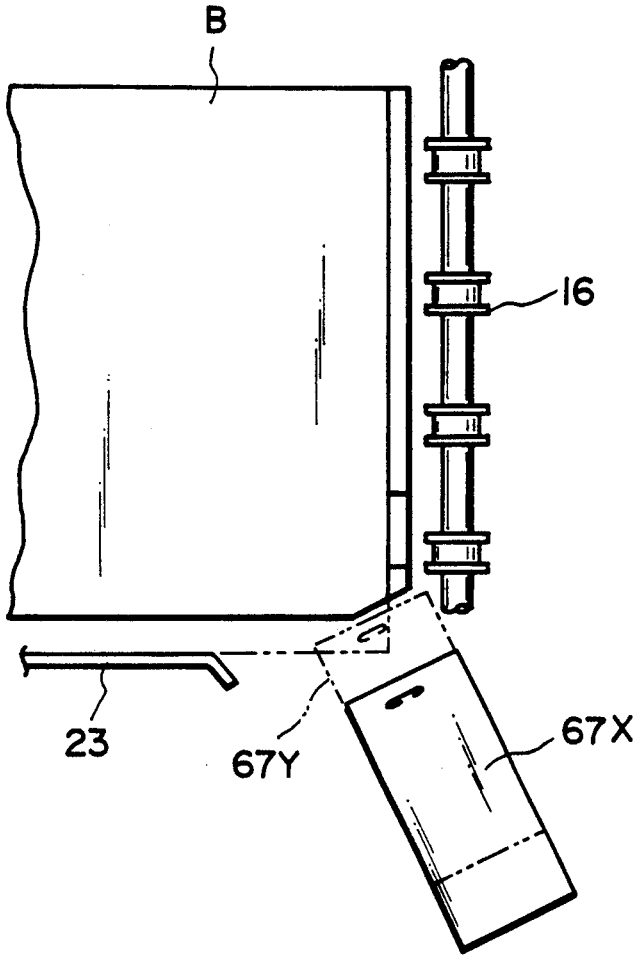
FIG. 2 is a sectional view taken along a line A in FIG. 1.

Referring to FIG. 2, the stapler (sheet binding mechanism) in this embodiment will be described. FIG. 2 is a top plan view of the stapler. The sheet binding mechanism 67 is retractable relative to the bin B of the sorter 1.

Figure 25:
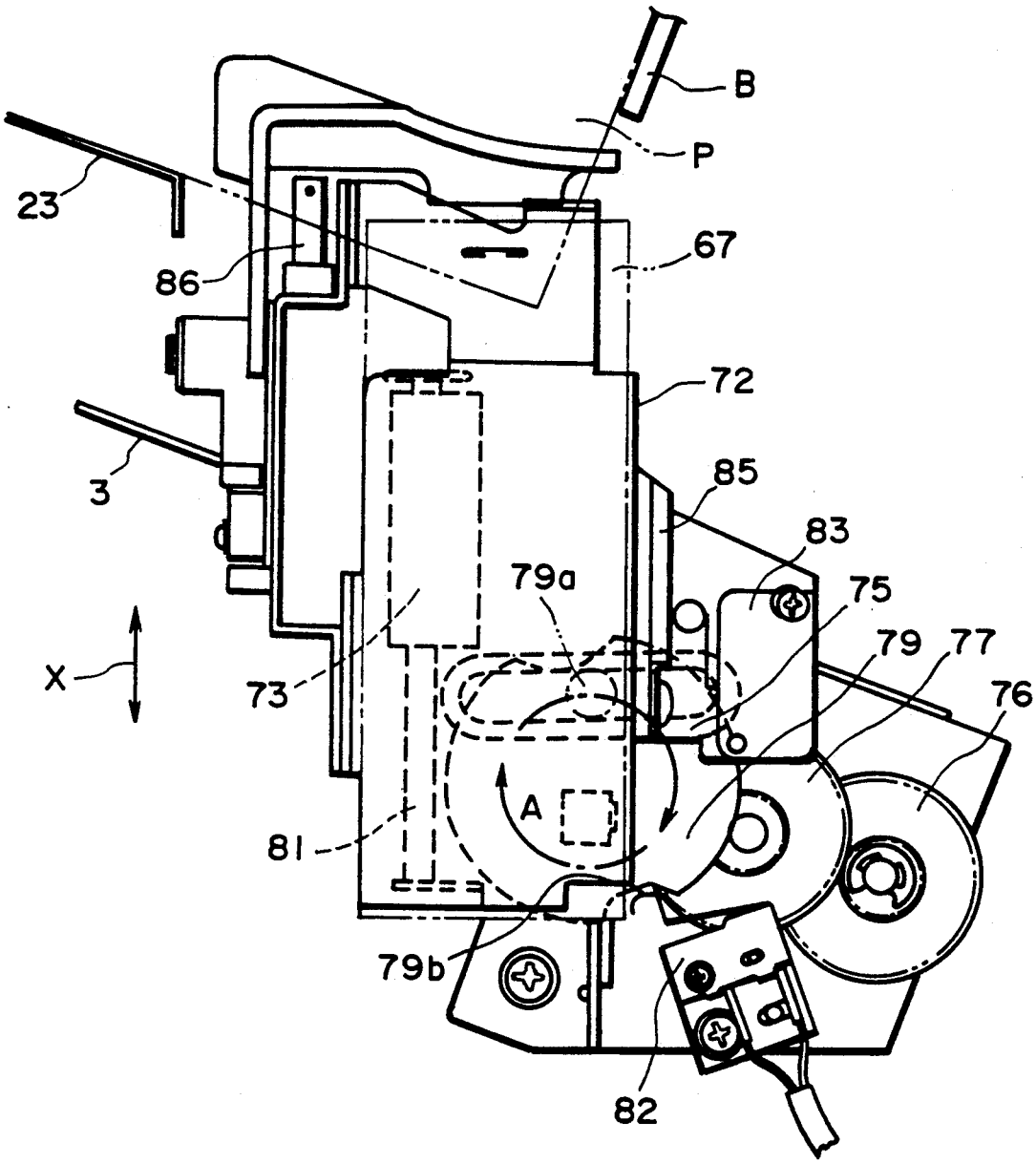
FIG. 25 is a top plan view of a stapling unit.
Figure 26:
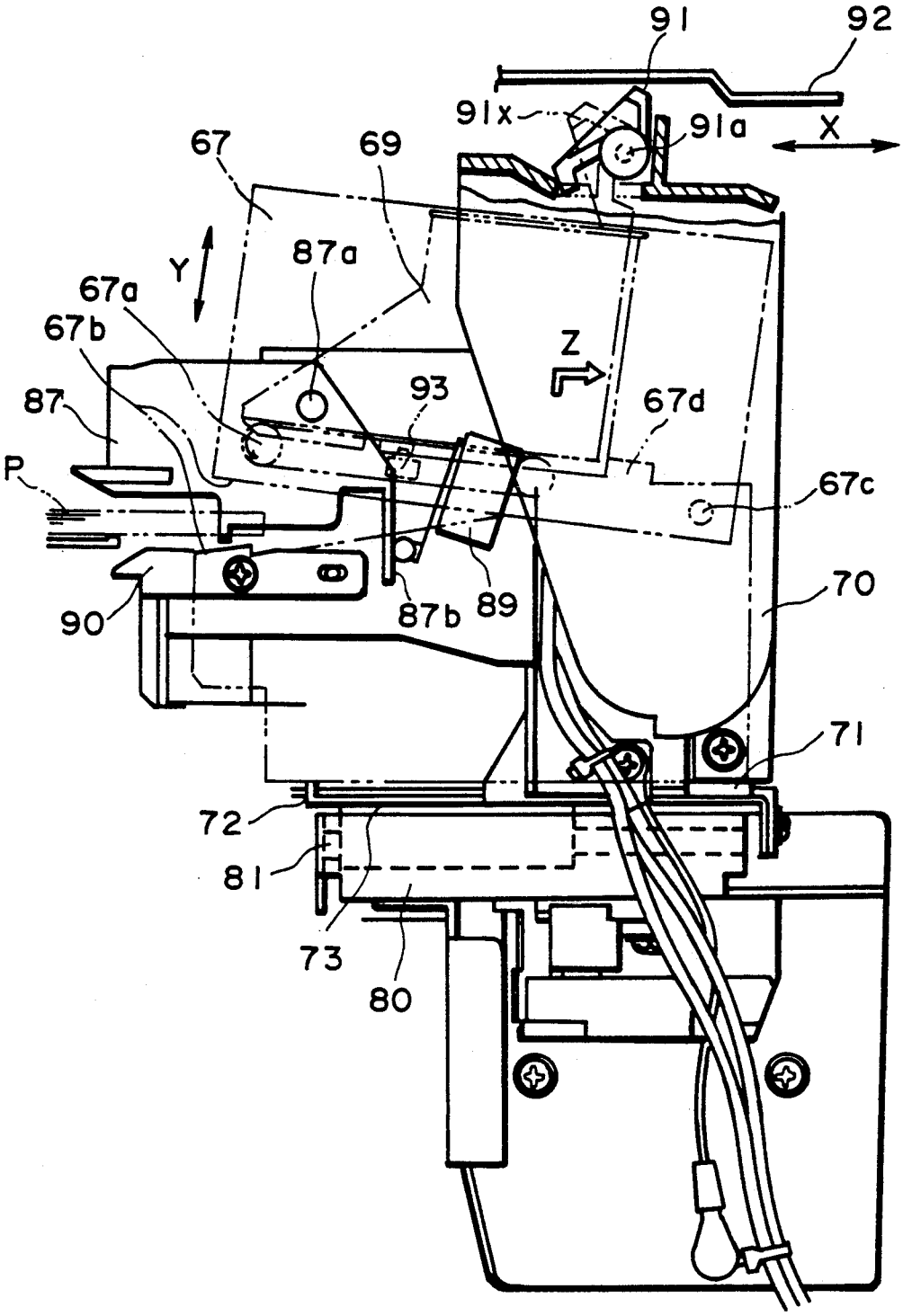
FIG. 26 is a side view thereof.

FIGS. 25 and 26 show in detail the structure of the stapler.

The stapler 67 indicated by chain lines in the Figure is in the form of a usual electric stapler and comprises a stapler cartridge 69 capable of accommodating a great number of stapled, a staple feeder 67*a* for feeding sequentially the staples from the staple cartridge 69 to the stapling position, and a stapling portion 67*b* for stapling the sheets P with the staple. The stapling portion 67*b* is rotatable about a rotational center 67*c*, and the upper unit of the stapler 67 which is movable in the direction Y in FIG. 26, and the lower unit sandwich the sheets P, when the stapling operation is carried out. The stapler 67 includes a stapler cover 70 for covering the motor and the driving system (not shown), and the stapler cover 70 is threaded on a stapler attachment metal plate 71, and the stapler 67 is threaded fixedly on the plate 71.

The plate 71 is threaded on a reciprocable table 72 to the bottom of the movable table 72, a movable guide 73 and slider roller 75 are fixed. The driving force from an unshown stapler driving motor is transmitted to a gear 79 by way of a gear (1) 76 and a gear (2) 77. The gear 79 has a projection 79*a* engageable with a roller slider 75, and is rotatable in the direction indicated by an arrow A.

The gear 79 have two microswitch actuators 79*b* at the proper positions. By one half rotation of the gear 79, the projection 79*a* rotates through an angle of 180 degrees, and therefore, the roller slider 75 is movable through a distance corresponding to a rotational diameter of the projection 79*a* of the gear 79. The guide 73 is engageable with a guiding shaft 81 to which the stapler fixing plate 80 is mounted so as to permit translational movement of the reciprocable table 72 having a stapler 67 together with the gear 79.

The rotation detecting microswitch 82 detects the half rotation of the gear 79, and the stapling unit position detecting microswitch 83 is engaged with a cam 85 mounted to the side surface of the movable table 72. Then, it is deactuated when the stapling unit is at the retracted position 67X retracted from the bin B, and it is actuated in the other conditions.

To an end of the reciprocable table 72, there is a transparent type sheet sensor in the form of a channel capable of sensing the sheet P. When the stapling unit reaches the sheet stapling position 67Y, the sheet P can be detected thereby. The above-described stapling unit and a unit permitting the reciprocable movement of the unit, are fixed on the side plate 3.

A taper guide 87 is tapered at the sheet inlet side end portions to prevent deviation of the leading edge of the sheet P when the stapling unit enters toward the sheet P (sheet stapling position 67Y). The taper guide 87 is rotatable about a rotational center 87*a*, and the trailing edge 87*b* thereof is urged in the counterclockwise direction by an unshown spring means so as to normally actuate the stapler safety microswitch 89.

For example, when the stapling unit enters to the sheets P (sheet stapling position 67Y), if a foreign matter, operators finger, or the stack of sheets exceeding the stapling power of the stapler 67 is on the bin B, such a moment as to raise the leading portion of the taper guide 87 about the bin B and the lower taper guide 90, so that the upper portion of the taper guide 87 rotates in the clockwise direction about the rotational center 87*a*. This deactuates the safety microswitch 89, and therefore, the power supply to the stapler 67 is shut by hardware.

The top portion of the stapler cover 70 is provided with an interlock arm 91 having a rotational center 91*a*. The interlock arm 91 is urged in the counterclockwise direction by an unshown spring means or the like, normally.

Above the interlock arm 91, there is an actuating plate 92 mounted on the side plate 3. When the stapling unit is at the sheet stapling position 67Y, the interlock arm 91 is moved to the position indicated by the solid lines by the movement of the staple unit in the direction X in FIG. 26. When the stapling unit is at the retracted position 67X, the interlock arm 91 is contacted to the end portion of the actuating plate 92. As indicated by reference 85X, the bottom portion of the arm of the interlock arm 91 is lowered to the staple cartridge 69 of the stapler 67.

The description will be made as to the detection of the staples of the stapler 67. In FIG. 26, a reference numeral 93 (chain lines) is a reflective type staple sensor. When the trailing edge of the bundle of the staples in the form of a sheet passes by the reflection type sensor 93, the absence of the staple is detected. At this time, some staples remain upstream of the sensor 93, and the leading end is retained by the stapler 67. When the absence of the staple is detected, the manual stapling button 95 is flickered, or the absence of the staple is displayed on the display of an image forming apparatus, not shown. By doing so, the replenishment of the staples is promoted. In this embodiment, when the refection type staple sensor 93 detects the absence of the staples, the stapling operation is prohibited.

Figure 27:
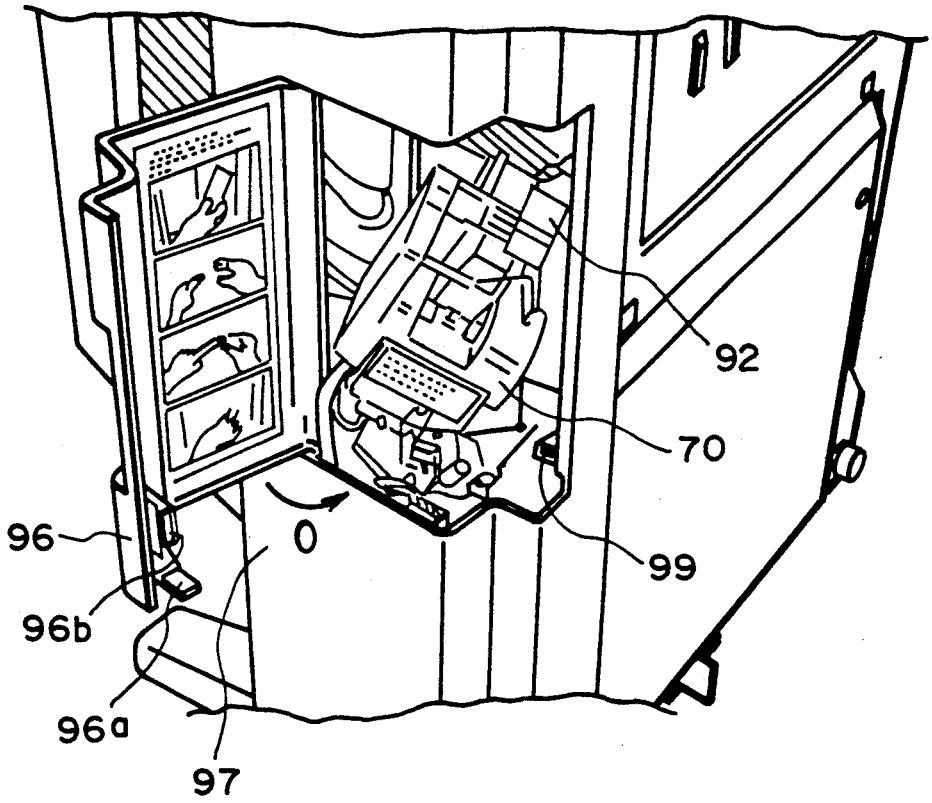
FIG. 27. is a perspective view thereof.

The replenishment of the staple cartridge will be described in conjunction with FIG. 27 which is a perspective view of a stapler in the sheet post-processing apparatus according to this embodiment of the present invention. In the Figure, the stapler unit is provided with an openable door 96 for permitting staple maintenance operation and replenishment of the staple cartridge. Below the door 69, it is formed into a projection for actuating a door switch. Designated by a reference **96*b* is a magnet catch for retaining the door. With this structure, when the door 96 is closed in the direction O, a joint switch 99 is actuated to permit operation of the sorter 1**.

In this embodiment, when the door 96 is opened while the reflection type staple sensor 93 of the stapler 67 is detecting the presence of the staples, the stapler 67 is maintained at the retracted position 67X. At this time, the interlock arm 91 is at the position indicated by the reference 91X, that is, the bottom portion of the interlock arm 91 is rotated to the stapler cartridge 69 of the stapler 67 and is raised thereby.

In order to take the staple cartridge 69 out of the stapler 67, the trailing end of the staple cartridge 69 is raised as indicated by reference Z in FIG. 26, and is retracted to the rear over the trailing side stopper **67*d* of the stapler 67. And therefore, when the interlock arm 91 takes the position 91X, that is, when the staple unit is in the state of 67X (the sensor 93 of the staple unit detects the presence of the staples), the staple cartridge 69 is not permitted to be removed from the stapler 67**.

When the door 96 is opened while the sensor 93 is detecting the absence of the staples (the state of the joint switch 99 is off), the staple unit is automatically stopped, as indicated by 67Y (FIG. 2) by the software. Then, the staple unit is moved to and stopped at the sheet stapling position 67Y (FIG. 2).

Figure 13:
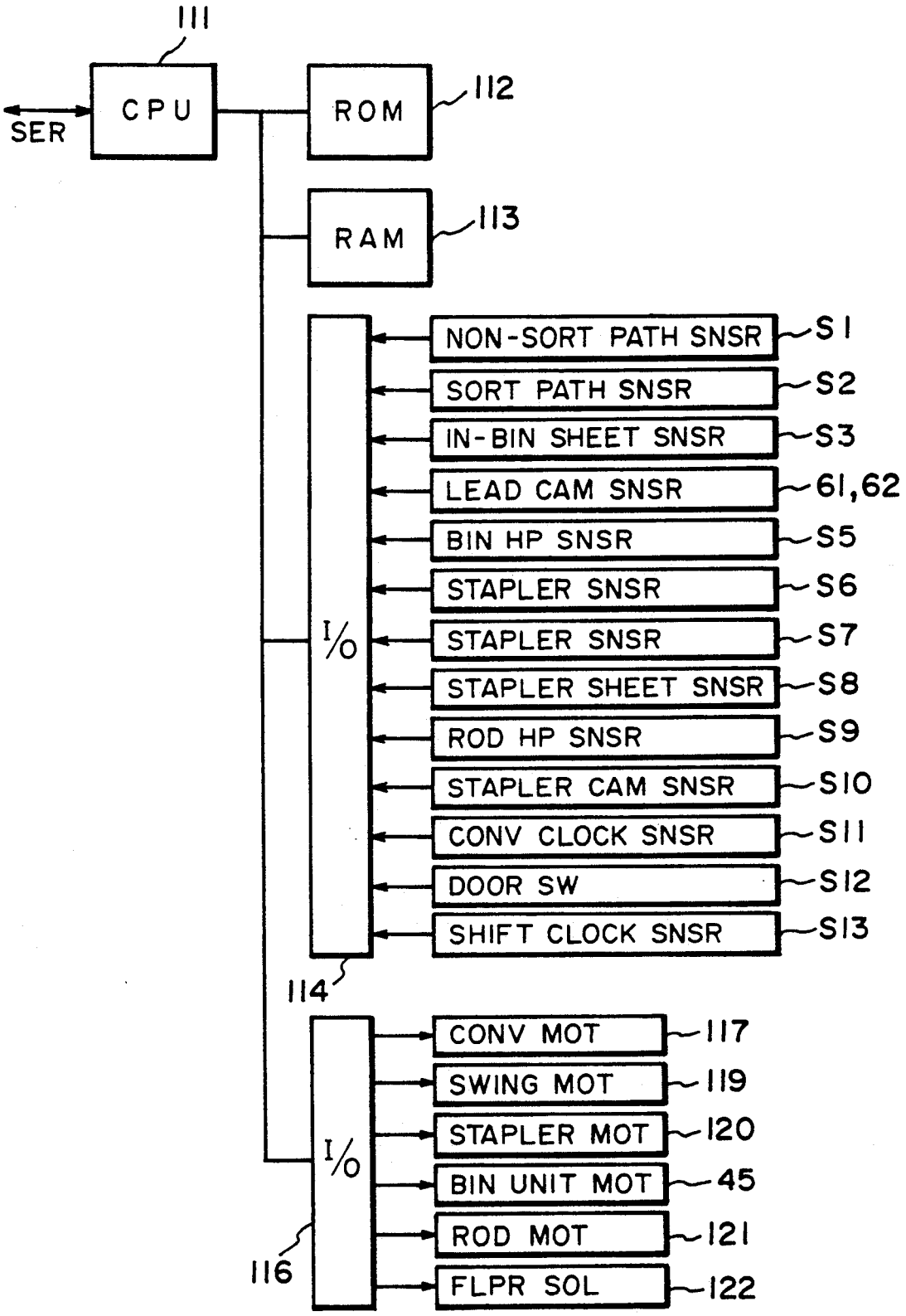
FIG. 13 is a block diagram of an example of a control device used with the sheet sorter according to the embodiment of the present invention.
Figure 14:
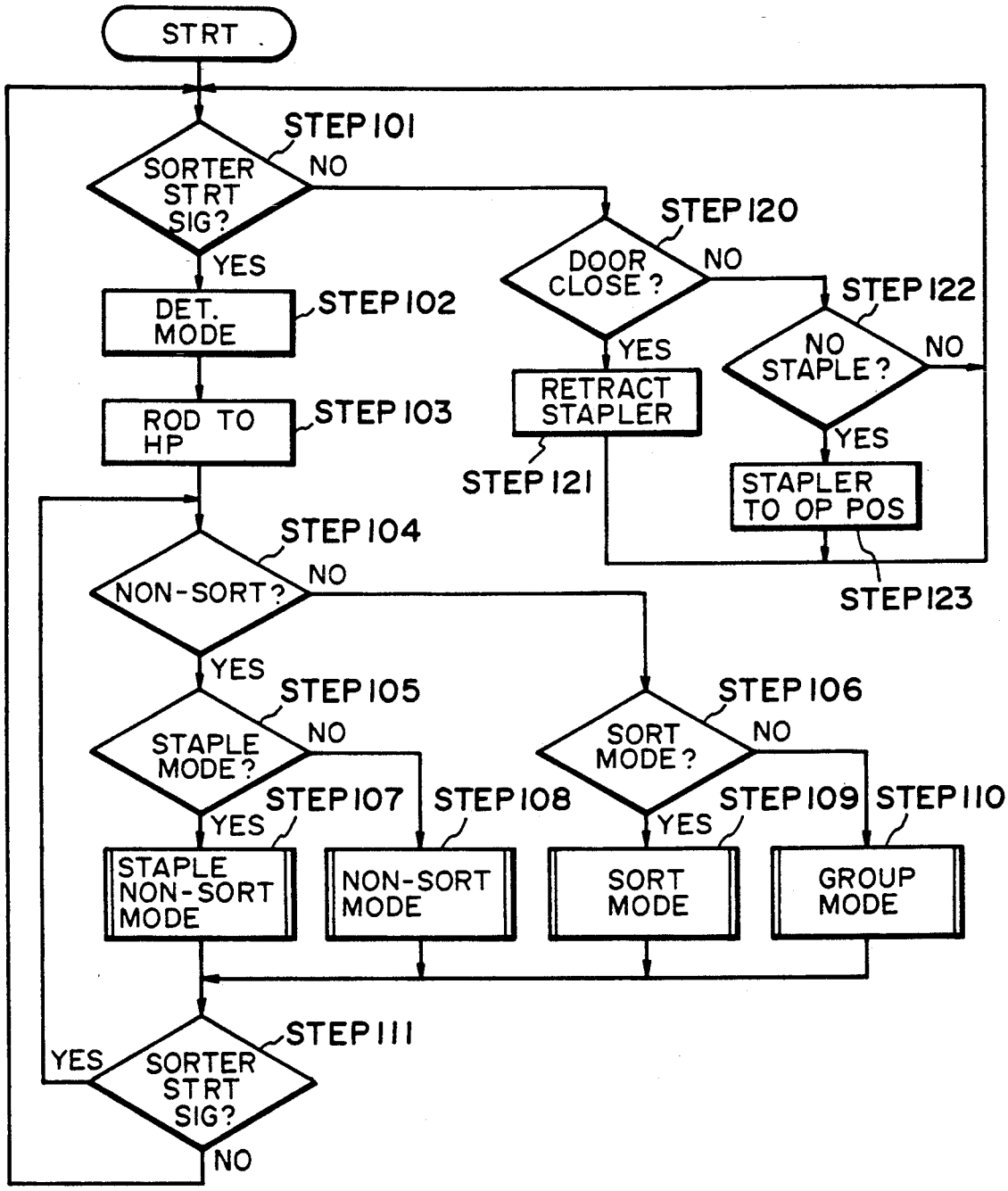
FIGS. 14 to 21, 22A and 22B are flow charts illustrating the sequential operations in the apparatus of this embodiment.

When the staple unit is in the state described above, the interlock arm 91, as shown by the solid lines in FIG. 13, is retracted from the upper part of the staple cartridge 69. By moving the rear end of the staple cartridge 69 in the direction Z in FIG. 13, the staple cartridge 69 is removed from the stapling unit. When the door 96 is closed (joint switch 99 is actuated), the stapling unit is restored to the retracted position 67X (FIG. 2), and therefore, the stand-by state is established.

In this embodiment, when the door 96 is opened, the stapling unit is not moved and maintained at the retracted position 67X when the staples are present. On the contrary, it is a possible alternative that the stapling unit is moved to the sheet stapling position **67*y* in the presence of the staples, and the interlock arm 91 takes the position indicated by the reference 91X; in the absence of the staples, the stapling unit is maintained stopped, and the interlock arm 91 locks the staple cartridge 69**. It is a further alternative that an interlock arm capable of being on-off controlled by solenoid or motor or the like is used. The same advantageous effects are provided.

As for the staple exchanging operation, the absence of the staple is detected when the rear end of the staple belt during the stapling operation exceeds the position of the refraction type staple belt sensor 93 in FIG. 13, and the system is temporarily stopped. The staples still remaining are automatically used after the staple belt is replenished.

A sequential operation will be described wherein the sheet P is fed from the image forming apparatus to the sorter 1 at the bin B, and the bin B is shifted, and the sheets P are aligned and stapled. The sheet P discharged from an image forming apparatus which is not shown but which is coupled with the sorter 1 (FIG. 1), is received by the receiving inlet 10 and is discharged to the bin by way of the inlet rollers 11 and the deflector 17. During the sheet discharging operation, the sheet P is discharged to the bin B from the upper discharging rollers 13 in the non-sort mode, and is discharged by way of the second sheet conveying passage 15 and the lower discharging rollers 16 to the bin B in the sort mode.

Using a sheet discharging signal from an unshown image forming apparatus, the sheet passing period and the sheet interval between the adjacent sheets are measured, and the information relating to the results of the measurement is supplied to a microcomputer in the bin unit 2. By the improper sheet conveying operation, the sheet detection period may exceeds a predetermined level, or the sheet P can not be detected within the predetermined period. If this occurs, stagnation or delay jam signal as in the usual sensor is supplied to the microcomputer of the image forming apparatus, and the entire system is stopped.

The microcomputer in the sorter 1 having received the information relating to the sheet passing period and the sheet interval, recognizes the sheet discharging time (the time in which the sheet is discharged to the sorter 1) and the sheet interval. On the basis of the data, the rotational speed and the position of the read cam 43 is controlled. The positional control for the lead cam **43*a* is carried out in accordance with the sheet discharging timing to the bin B and the synchronization between the parallel portion H of the lead cam 43** and the start timing.

A clock disk 56 (FIG. 6) mounted on the output shaft **45*a* of the shift motor 45 for driving the lead cam 43 and the interrupter 59, it is possible to detect the speed of the lead cam 43. By the flags 61 and 62 (FIG. 7 and FIG. 8) disposed below the lead cam shaft 42, an end and the other end of the parallel portion H of the lead cam 43** can be detected.

During the upward movement of the bin unit 2 in the sorting mode, when the trunnion 33 of the bin B comes to the home position 33X shown in FIG. **24*a*, the sheet discharge is started, and the sheet discharging is finished before the trunnion 33 moves from the home position 33X to the position 33Y**. This is accomplished by properly setting the rotational speed of the lead cam.

During the movement between the position 33Y and **33*z*, the bin unit 2** is shifted, the time period corresponding to the sheet interval is recognized by the information described above, and therefore, the rotation from the position 33Y to the 33z of the trunnion 33 is finished within the sheet interval period. At this time, the next bin B reaches the position 33X to receive the next sheet P. This operation is repeated for each of the bins B.

During the downward sorting operation of the bin unit 2, the sheet discharge is started when the trunnion 33 of the corresponding bin B comes to the position 33Y, and the sheet discharging is finished before the position 33X is reached. In the sheet interval period, the trunnion 33 is rotated from the position 33X to the position 33w, and the next bin reaches to the receiving inlet 33Y. The above-described operations are repeated.

During the sheet discharging operation, the variation in the process speed of the image forming apparatus and the variation in the sheet intervals are supplied to the microcomputer of the bin unit 2 from the main assembly of the image forming apparatus, and therefore, the speed control of the trunnion 33 is under a feed back control on the basis of the updated data.

With the above-described structure of the sorter 1, the sorter suitably meets the difference of the discharging period depending on the size of the sheets, different image forming machines having process speed and different sheet intervals, because the optimum lead cam control is possible in accordance with the performance of the image forming apparatus. Therefore, the sorter (sheet post-processing apparatus) usable with a variety of machines, can be provided.

The stapling operation for stapling the aligned sheets P will be described. In this embodiment, after all of the copy sheets are aligned in the bins, the stapling operation is carried out sequentially from the bin B at which the alignment operation is finally carried out.

The process will be described in brief. After the last sheet is aligned, the aligning rod 26 again urges the stacked sheets (for all bins) to the reference walls 23. The degree of the urging by the aligning rod 26, for the reasons described in the foregoing, is smaller than in the aligning operation in this embodiment (the degree of urging a is nearly equal to zero in this embodiment). Therefore, the alignment performance is improved irrespective of the number of the sheets P.

As described in the foregoing, the entire sheets P are retained by the aligning rod 26. A curl stopper is disposed in an opening of the staple unit, and adjacent sheet inlet formed between the upper taper guide 87 and the lower taper guide 90. The curl stopper is not shown in the Figure. It is effective to limit the degree of the upward curl below a predetermined level (height between the surface of the bin B and the taper starting portion of the upper taper guide 87).

With this state, the staple unit moves from the position 67X to the position 67Y in FIG. 2. At this time, the upward curl of the sheet P in the bin B is limited by the curl stopper. As regards the downward curl in which a part of the sheets suspends from an end of the bin B, it is raised by the taper portion of the lower taper guide 90 so that the lower taper guide 90 functions as as jumping base at the top thereof so that it does not jammed in the opening of the stapler 67. With this structure, the upward curled or lowered curled sheet can be supplied to the opening of the stapler 67.

When the staple unit reaches the position of 67Y, the sheet P is detected by the transparent sensor 86. Only when the sheet P is on the bin B, the sheet P is stapled. Upon the completion of the stapling operation, the stapling unit is returned to the retracted position 67X where the bin and the sheets P thereon does not interfere the stapler unit even if the bin B is shifted.

When the staple unit returns to the retracted position 67X, the staple unit position detecting microswitch 63 is deactuated to permit the rotation of the shift motor 45. Then, the bin unit is shifted up or down, and the stapling operation for the next bin B is carried out in the similar manner described above.

When the bin B is shifted with the staple unit at the position 67Y, the end of the staple unit interferes the bin B or the sheet P thereon. In the worst case, the sheets, bin or the staple unit will be damaged. Only when the staple unit position detecting microswitch 83 is off, the power supply circuit to the bin unit is established. This is assured by the hardware, and therefore, if the software fails, the bin shift is prevented when the stapling unit is at the position 67Y.

If the stapling unit is improper, or in the like situation, the stapling operation may be started when the number of stacked sheets on the bin exceeds the stapling power of the stapling unit. If this occurs, the stapler 67 stops during its operation due to the overload. If the stapling unit returns to the position 67 with this state maintained, and then the bin B is shifted, the sheet P may be damaged. In consideration of this, one rotation (one step) sensor (not shown) of the stapler 67 detects that the stapler 67 does not return to the home position within a predetermined period after the start of the operation (the sensor is in the timer circuit). Then, the stapler 67 is rotated in the reverse direction by one full turn, thus returning it to the home position. Thereafter, it is returned to the position 67X.

In this case, the stapling unit rotates through one full turn in the predetermined direction, and therefore, an abnormal state signal of the stapler is produced by an unshown control circuit, and the event is displayed on the display of the image forming apparatus.

In this embodiment, when the stapler moves once in the opposite direction, the abnormal state is immediately determined. However, it is probable that the stapler is operable in good order when rotated in the predetermined direction again after the reverse rotation thereof to the home position. Even if the staple is not fed in good order only once, the one reverse rotation may be enough to re-establish the normal state.

In consideration of this, it is not desirable to stop the system only upon one reverse rotation of the stapler 67. Therefore, the number of reverse rotations prior to the determination of the abnormal state of the stapler may be two or more. The number of steps for discriminating the abnormal state may be increased to two or three. For example, when the stapler 67 is reversely rotated in the stapling operation for the first bin B, the bin B may be shifted, and the second stapling operation is tried. If the stapler 67 effects the proper stapling operation with one rotation at this time, the system operation is continued. If the reverse rotation occurs in the second try, the abnormal state of the stapler may be determined, and the signal is produced. This is a possible alternative.

Figure 28:
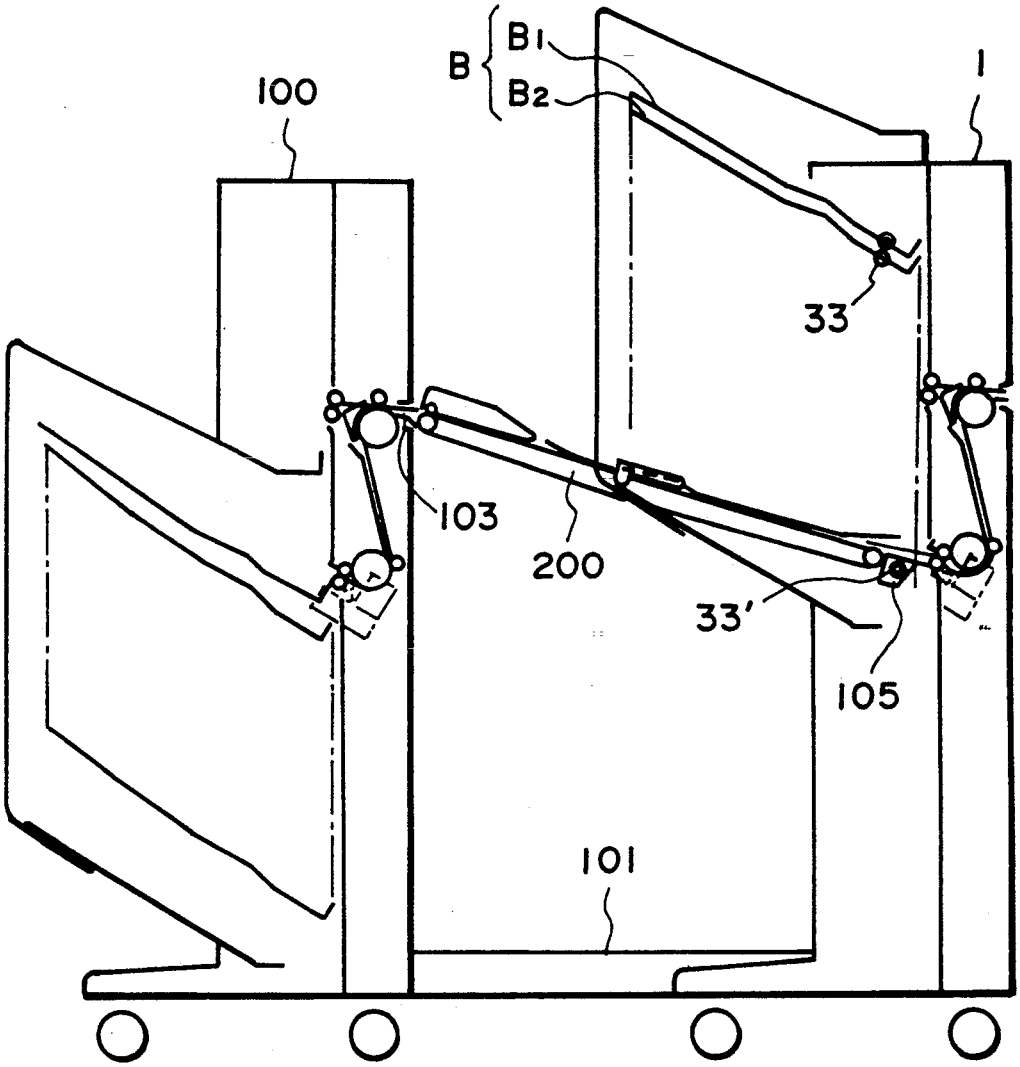
FIG. 28 is a longitudinal section view of a double arrangement sorter.

Referring to FIG. 28, a double sorter arrangement will be described. FIG. 28 shows a sectional view of a double sorter arrangement having the same sorters. In this embodiment, the first sorter 1 and the second sorter 100 are the same sorter which are coupled in parallel to provide double capacity for the sheets accommodation.

Figure 29:
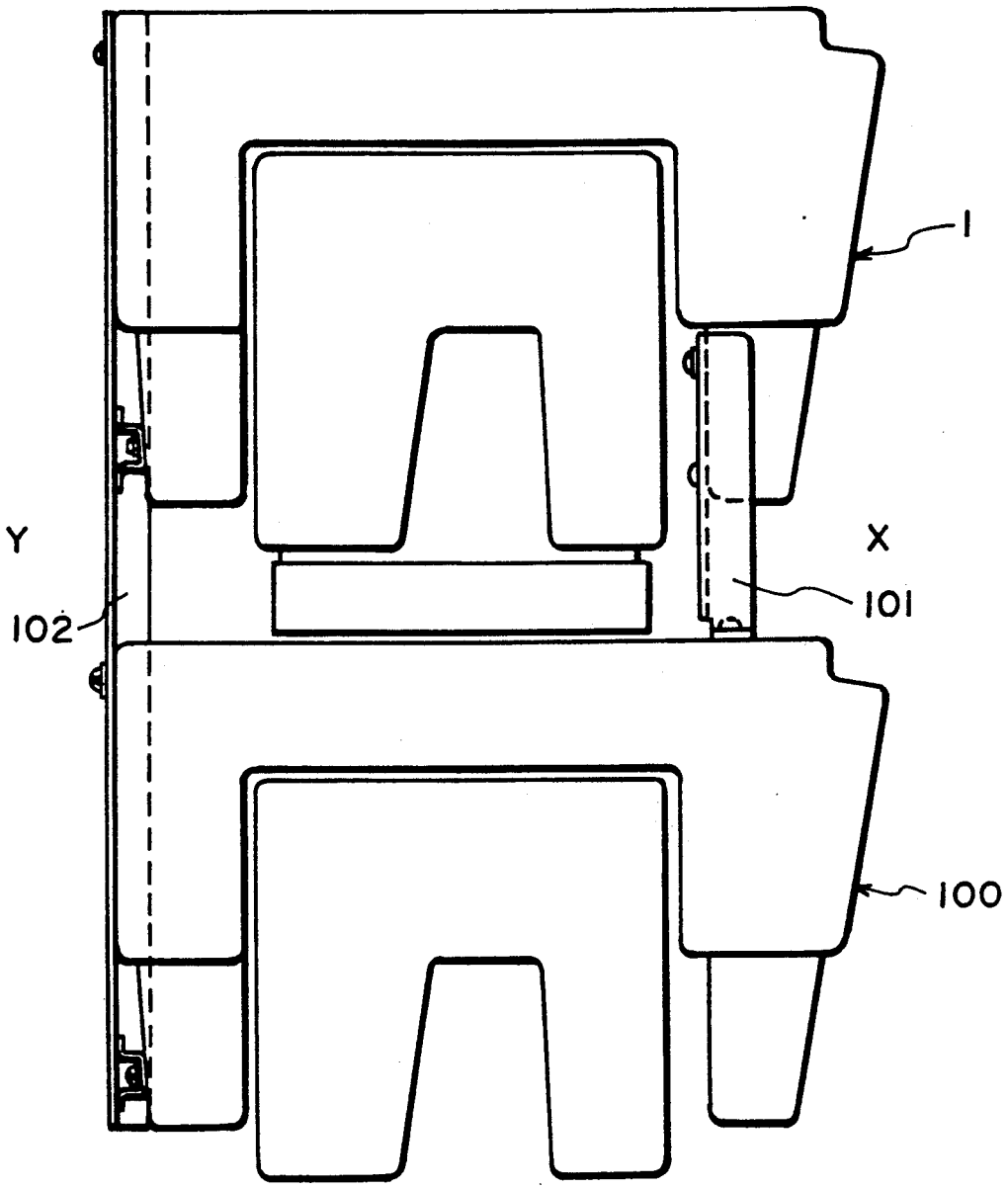
FIG. 29 is a top plan view thereof.

FIG. 29 is a top plan view of the double sorter arrangement. The sorters 1 and 100 are coupled by fixing them on rails 101 and 102 by screws at the front and rear sides X and Y.

The communication and the power supply to the first and second sorters are provided by a wire extending from an unshown power source behind the sorters 1 and 100. The cable from the sorter 100 is connected to the connector of the power source code table, and the cable from the sorter 1 is connected to the connector table (not shown) at the rear side cf the image forming apparatus, so that the connection is established between the image forming apparatus, sorter 1 and the sorter 100 in this order.

As an advantage of this embodiment, as many as sorters as permitted by the power source, can be connected and used together. In this embodiment, only two sorters are connected, but the present invention permits 3, 4 or more sorters. Therefore, the capacity of the sorter can be increased as long as the installing space and the power supply permit.

The sheet passage structure between the sorter 1 and the sorter 100 will be described. In this embodiment, a stay 105 is at the bottom of the bins. The stay 105, similarly to the bins B, have trunnions 33' which is rotatably supported. To the double stay structure 105, the conveying passage unit 200 is threaded or suitably mounted detachably.

By doing so, when the trunnion 33' moves vertically by the lead cams 42*a* and 42*b*, the conveying passage unit 200 correspondingly moves. More particularly, it is lifted to a predetermined position to permit reception of the sheet P at a position facing to the lower discharging roller 16 of the sorter 1 (the position where the bin B receives the sheet P; the parallel portion of the lead cam).

Figure 30:
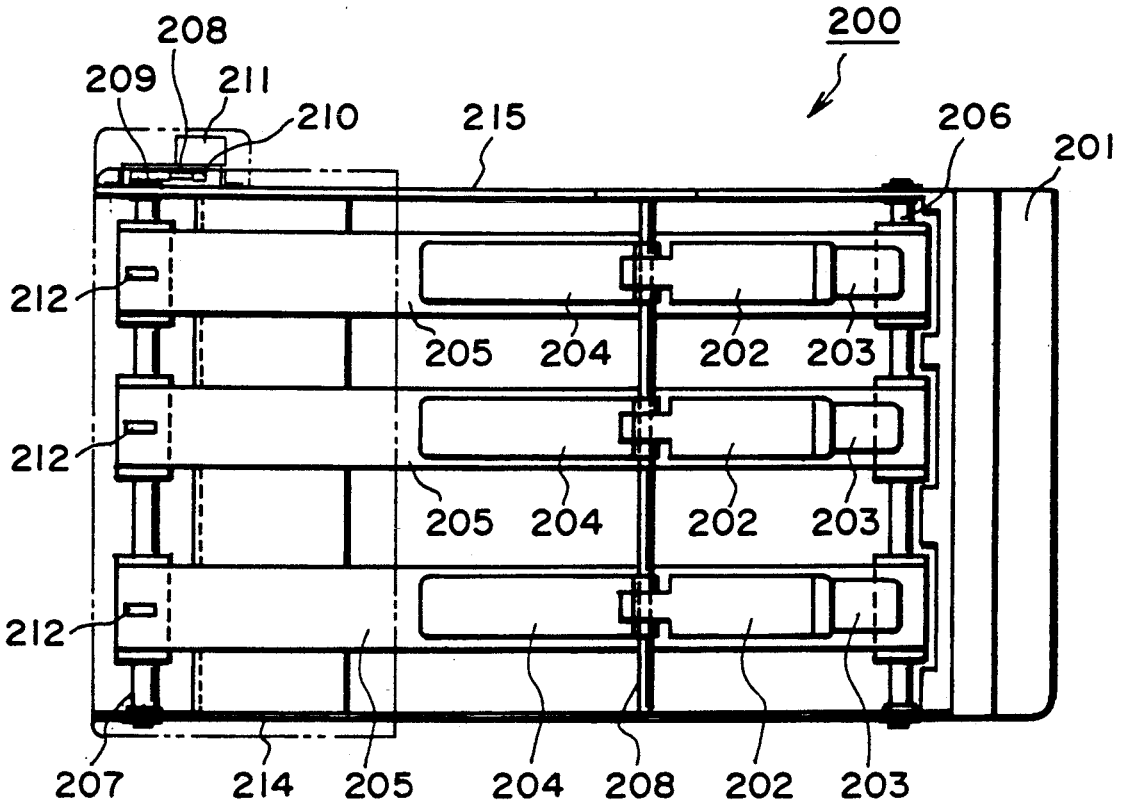
FIG. 30 is a top plan view of the conveying path thereof.
Figure 31:
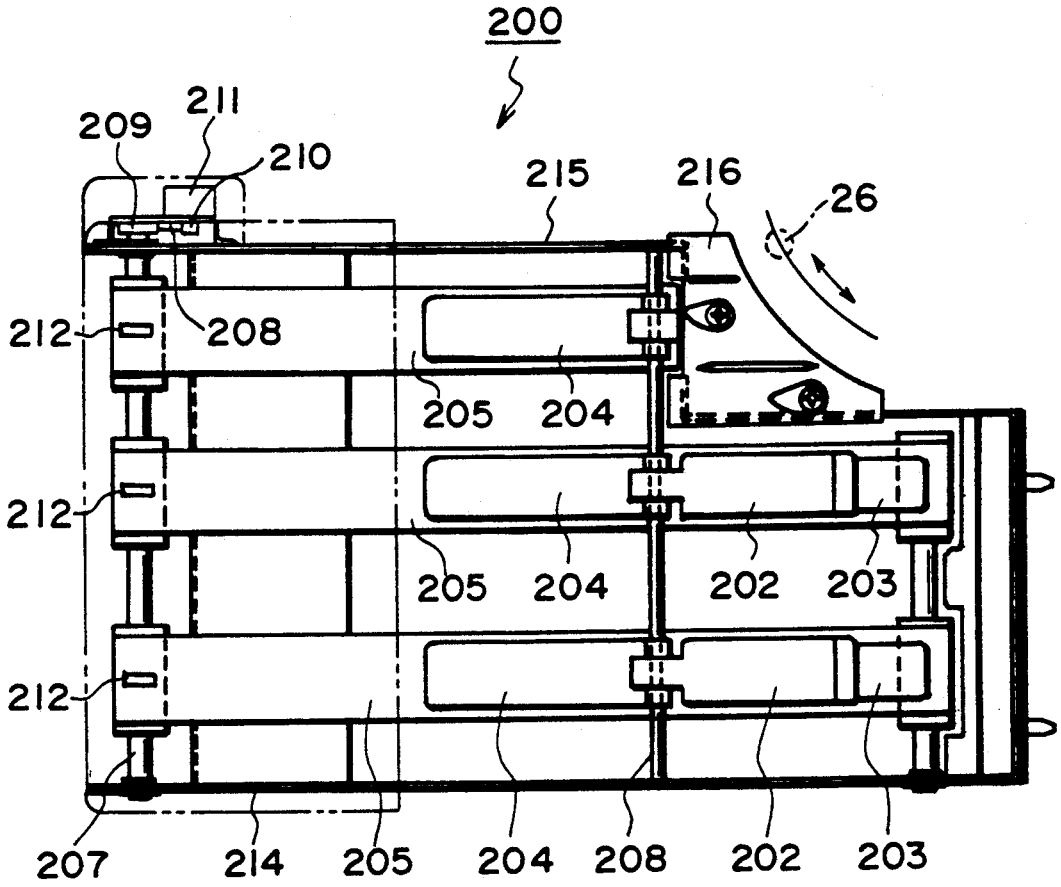
FIG. 31 is a top plan view of the path having aligning means.

Referring to FIG. 30, the structure of the connecting passage unit 200 will be described. Reference numerals 201 and 202 designate an inlet guide for the passage unit 200, and an inlet weight for conveying the sheet P, respectively. To an end of the inlet weight 202, a lead spring 203 is mounted which is normally pressed to the upper bin B to guide the insertion of the sheet P when the two sorters are used.

FIG. 30 is a top plan view of the conveying passage unit 200. A rubber belt 205 is stretched between roller shafts 206 and 207, and between a pulley 209 of the shaft 207 and a pulley 210 of the motor 211, a timing belt 208 is trained. By the rotation of the motor 211, the roller shaft 207 and the rubber belt 205 are driven by way of the timing belt 208.

On the rubber belt 205, the inlet weight 202 and an intermediate weight 204 swingable about a shaft 208 are placed. The sheet P discharged by the lower discharging rollers 16 is fed onto the rubber belt 205 by the inlet guide 201, and is fed to the downstream side by the inlet weight 202 and the intermediate weight 204. At the outlet of the conveying passage unit 200, there is sheet discharging rollers 212 to introduce the sheet to the inlet 103 of the sorter 100.

In the case of the sorter capable of aligning the sheets P by an aligning rod 26 penetrating through the bin unit, a unit for driving the aligning rod is disposed below the passage unit 200. The operating range of the aligning rod 26 is permitted by a recess as in the bin B. In order to improve the sheet conveying performance at the recess portion, a smooth sheet guide 216 (FIG. 30) is provided adjacent the recess. The sheet guide 216 is threaded or mounted by proper means so that the tops of the screws are below the conveying path so as not to interfere the sheet P.

Next, the flow of the sheet P in the case of the double sorter structure will be described. First, the case will be dealt with in which a number of sets of sheets are produced, the number $(n+\alpha)$ is larger than the number n of the bins of one sorter. The sorter operates first to complete the stapling n sets of sheets. Then, the bin of the first sorter is shifted so as to properly face the passage unit 200. Then, the sorting or grouping operation for the remaining sets $\alpha$ of the sheets, and the stapling operation is carried out if desired.

In such an operation, the sets of sheets having been subjected to the post-processing operation in the first sorter, can be taken out. If $\alpha > n$, the first sorter is operated again after the post-processing operation of the second sorter to effect the post-processing operation for the rest of the sheets (sorting, grouping, stapling, automatically). At this time, the detecting is made as to whether there is a set of sheets in the first sorter as a result of the first operation thereof. It is carried out using a bin penetrating sensors 400 and 400' of a transparent type (FIG. 4). Only when there is no sheet P in the bin, the automatic operation is started. If the sheet P is in the bin, the operation does not start until the operator takes the set of sheets out.

The structure is advantageous, because a desired any number of sets of prints can be set in the image forming apparatus. The operation is performed for each n bins, and first, second, first sorters are operated. When the operation is carried out in the first sorter, the sets of sheets in the second bin may be removed. After the sheets are removed, the second sorter can be operated again after the completion of the operation of the first sorter. The present invention is applicable to the double or more sorters. If only one sorter is used, n sets of sheets are post-processed, and thereafter, all of the sheets P are removed from the bins, and then, the system automatically starts to effect the rest of the operations.

When the sorter of this embodiment is coupled with an image forming apparatus having a document feeder with reserving function, the consideration has to be made in connection with the original accommodator of the document feeder and the original accommodator of the reserving device. First, the operation is started with the first sorter for the originals in the original accommodator. After the completion of the operation, the second sorter is automatically started for the originals in the original accommodator of the reserving device. The first user can take the copies out of the first sorter even if the post-processing is being effected in the second sorter for the originals of the second user. Then, the first sorter can effect the operation for the third reserved user. Thus, the apparatus of the present invention can be developed further.

The first and second sorters may be provided with the sorting function as in this embodiment, but may not be provided with such a function. Only first sorter may have the stapling function, but the second sorter is not provided with the stapling function. This can be reversed. When both of the sorters have the stapling function, and when the staple in the first sorter becomes empty when the operation is in the automatic stapling mode, and when the second sorter still has the staples, the automatic stapling mode operation is immediately started automatically in the second sorter.

The sorter 1 of FIG. 1, as shown in FIG. 13, comprises a central processing unit (CPU) 111, read only memory (ROM) 112, random access memory (RAM) 113, input port 114, output port 116 or the like. They constitute a control system 110. A control program is stored in the ROM 112, and in the RAM 113, the input data or the working data are stored. The input port 114 is connected with various sensors and switches such as non-sort path sensor S1 or the like. The output port 116 is connected with various loads such as the conveying motor 117 for driving the inlet rollers 11 and the lower discharging rollers 16. The CPU 111 controls various parts through the bus in accordance with the control program stored in the ROM 112. The CPU 111 is provided with a serial interface to effect the serial communication with the CPU of the copying apparatus, for example, so as to control various parts in accordance with the signals from the copying apparatus.

While the invention has been described with reference to the structures disclosed herein, it is not confined to the details set forth and this application is intended to cover such modifications or changes as may come within the purposes of the improvements or the scope of the following claims.

We claim:

1. A sheet post-processing apparatus, comprising:
trays for accommodating discharge sheets;
aligning means for aligning the sheets on said trays by urging edges of the sheets;
driving means for driving said aligning means;
supporting means for rotatably supporting said aligning means;
elastic means disposed between said aligning means and said driving means; and
control means for controlling said driving means to change a degree of urging of said aligning means in accordance with a size of the sheets accommodated in said trays, wherein the degree of urging corresponds to a distance through which said aligning means moves in a lateral direction of the sheets after contacting the edges of the sheets, and wherein said control means changes a rotational amount of said aligning means through said driving means in accordance with a size of the sheets.

2. An apparatus according to claim 1, further comprising means for binding sets of sheets accommodated in said trays, wherein said aligning means urges the edges of the sheets with a smaller degree of urging when said binding means is operated than during the alignment operation of said aligning means.

3. A sheet post-processing apparatus comprising:
trays for accommodating discharge sheets;
aligning means for aligning the sheets on said trays by urging edges of the sheets;
driving means for driving said aligning means;
supporting means for rotatably supporting said aligning means; and
control means for controlling said driving means to change a degree of urging of said aligning means in accordance with a size of the sheets accommodated in said trays, wherein the degree of urging corresponds to a distance through which said aligning means moves in a lateral direction of the sheets after contacting the edges of the sheets, wherein said driving means is an electric driving means, and said aligning means has an aligning member and a rotatable arm, and wherein a spring member is disposed between said rotatable arm and said aligning member.

4. An apparatus according to claim 3, wherein said trays are vertically arranged, and said aligning member has an aligning rod penetrating through said trays.

5. An apparatus according to claim 1, wherein said aligning means includes a first aligning member fixed at a position and a second aligning member for urging the sheets to the first aligning member.

6. An image forming apparatus with a sheet post-processing device, comprising:
an image forming station;
trays for accommodating discharge sheets;
aligning means for aligning the sheets on said trays by urging edges of the sheets;
driving means for driving said aligning means;
supporting means for supporting said aligning means for rotation;
elastic means disposed between said aligning means and said driving means; and
control means for controlling said driving means to change a degree of urging of said aligning means in accordance with a size of the sheets accommodated in said trays, wherein the degree of urging corresponds to a distance through which said aligning means moves in a lateral direction of the sheets after contacting the edges of the sheets, and wherein said control means changes a rotational amount of said aligning means through said driving means in accordance with a size of the sheets.

7. A sheet post-processing apparatus, comprising:
trays for accommodating discharge sheets;
aligning means for aligning the sheets on said trays by urging edges of the sheets;
driving means for driving said aligning means;
supporting means for movably supporting said aligning means; and
control means for controlling said driving means to change a degree of urging of said aligning means in accordance with a number of the sheets accommodated in said trays, wherein the degree of urging of said aligning means corresponds to a distance through which said aligning means moves in a lateral direction of the sheets after contacting the edges of the sheets.

8. A sheet post-processing apparatus, comprising:
trays for accommodating discharge sheets;
aligning means for aligning the sheets on said trays by urging edges of the sheets;
binding means for binding the sheets;
driving means for driving said aligning means;
supporting means movably supporting said aligning means; and
control means for controlling said driving means to change a degree of urging of said aligning means so that the degree is lower when said binding means is in operation than during an aligning operation of said aligning means, wherein the degree of urging corresponds to a distance through which said aligning means moves in a lateral direction of the sheets after contacting the edges of the sheets.

9. An image forming apparatus, comprising:
an image forming station;
a sheet post-processing device having trays for accommodating discharge sheets; aligning means for aligning the sheets on said trays by urging edges of the sheets; driving means for driving said aligning means;

supporting means for movably supporting said aligning means; and control means for controlling said driving means to change a degree of urging of said aligning means in accordance with a number of the sheets accommodated in said trays, wherein the degree of urging corresponds to a distance through which said aligning means moves in a lateral direction of the sheets after contacting the edges of the sheets.

10. An image forming apparatus, comprising:

an image forming station;

a sheet post-processing device having trays for accommodating discharge sheets; aligning means for aligning the sheets on said trays by urging edges of the sheets; binding means for binding the sheets; driving means for driving said aligning means;

supporting means for supporting said aligning means; and control means for controlling said driving means to change a degree of urging of said aligning means so that the degree is lower when said binding means is in operation than during an aligning operation of said aligning means, wherein the degree of urging corresponds to a distance through which said aligning means moves in a lateral direction of the sheets after contacting the edges of the sheets.

11. A sheet post-processing apparatus, comprising:

trays for accommodating discharge sheets;

aligning means for aligning the sheets on said trays by urging edges of the sheets;

driving means for driving said aligning means;

supporting means for rotatably supporting said aligning means; and control means for controlling said driving means to change a degree of urging of said aligning means in accordance with a size of the sheets accommodated in said trays, wherein the degree of urging corresponds to a distance through which said aligning means moves in a lateral direction of the sheets after contacting the edges of the sheets, and wherein said control means changes a rotational amount of said supporting means in accordance with a size of the sheets.

12. An apparatus according to claim 3, wherein said control means changes a rotational amount of said rotatable arm through said electric driving means in accordance with a size of the sheets.

13. An image forming apparatus with a sheet post-processing apparatus, comprising:

an image forming station;

trays for accommodating discharge sheets;

aligning means for aligning the sheets on said trays by urging edges of the sheets;

driving means for driving said aligning means;

supporting means for rotatably supporting said aligning means; and control means for controlling said driving means to change a degree of urging of said aligning means in accordance with a size of the sheets accommodated in said trays, wherein the degree of urging corresponding to a distance through which said aligning means moves in a lateral direction of the sheets after contacting the edges of the sheets, wherein said driving means is an electric driving means, and said aligning means has an aligning member and a rotatable arm, and wherein a spring member is disposed between said rotatable arm and said aligning member.

14. An image forming apparatus with a sheet post-processing apparatus, comprising:

an image forming station;

trays for accommodating discharge sheets;

aligning means for aligning the sheets on said trays by urging edges of the sheets;

driving means for driving said aligning means;

supporting means for rotatably supporting said aligning means; and control means for controlling said driving means to change a degree of urging of said aligning means in accordance with a size of the sheets accommodated in said trays, wherein the degree of urging corresponds to a distance through which said aligning means moves in a lateral direction of the sheets after contacting the edges of the sheets, and wherein said control means changes a rotational amount of said aligning means through said driving means in accordance with a size of the sheets.

* * * * *

UNITED STATES PATENT AND TRADEMARK OFFICE

CERTIFICATE OF CORRECTION

PATENT NO. : 5,289,250

DATED : February 22, 1994

INVENTOR(S) : Masakazu Hiroi, et al.

It is certified that error appears in the above-indentified patent and that said Letters Patent is hereby corrected as shown below:

On title page, item [56] under "Foreign Patent Documents" "1-17172 5/1989 Japan" should read --1-117172 5/1989 Japan--.

Column 1,
Line 21, "sheets" should read --sheets.--.

Column 3,
Line 39, "accompanying" should read --accompanying drawings.--.

Column 5,
Line 59, "easily" should read --easy--.

Column 6,
Line 10, "rod 26" should read --rod 26, and--.

Column 7,
Line 12, "empirically" should read --empirically.--;
Line 44, "sheet" should read --sheet is--; and
Line 51, "moment" should read --movement--.

UNITED STATES PATENT AND TRADEMARK OFFICE

CERTIFICATE OF CORRECTION

PATENT NO. : 5,289,250
DATED : February 22, 1994
INVENTOR(S) : MASAKAZU HIROI, ET AL.

It is certified that error appears in the above-indentified patent and that said Letters Patent is hereby corrected as shown below:

Column 10,
Line 35, "moment" should read --movement--.

Column 11,
Line 25, "is" (2nd occurrence) should read --are--.

Column 13,
Line 8, "if" (second occurrence) should be deleted.

Column 16,
Line 15, "the" (first occurrence) should be deleted; and
Line 67, "is" (second occurrence) should be deleted.

Column 21,
Line 59, "as" (second occurrence) should read --a--; and
Line 60, "not" should read --not yet--.

Column 22,
Line 1, "does" should read --do--.

Column 23,
Line 9,"cf" should read --of--.

UNITED STATES PATENT AND TRADEMARK OFFICE

CERTIFICATE OF CORRECTION

PATENT NO. : 5,289,250
DATED : February 22, 1994
INVENTOR(S) : MASAKAZU HIROI, ET AL.

It is certified that error appears in the above-indentified patent and that said Letters Patent is hereby corrected as shown below:

Column 24,
Line 6, "duced," should read --duced, and--.

Column 25,
Line 45, "a" should read --the--.

Column 28,
Line 4, "a" should read --the--.

Signed and Sealed this

Eighteenth Day of October, 1994

Bruce Lehman

*Attest:*

BRUCE LEHMAN

*Attesting Officer*

*Commissioner of Patents and Trademarks*